US007192029B2

(12) United States Patent
Fukatsu et al.

(10) Patent No.: US 7,192,029 B2
(45) Date of Patent: Mar. 20, 2007

(54) SHEET CONVEYING APPARATUS, SHEET POST-PROCESSING APPARATUS, AND IMAGE FORMING APPARATUS PROVIDED WITH SHEET CONVEYING APPARATUS AND IMAGE FORMING APPARATUS

(75) Inventors: Masayoshi Fukatsu, Shizuoka (JP); Takashi Kuwata, Shizuoka (JP); Junichi Sekiyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/262,914

(22) Filed: Nov. 1, 2005

(65) Prior Publication Data

US 2006/0071418 A1 Apr. 6, 2006

Related U.S. Application Data

(62) Division of application No. 10/622,474, filed on Jul. 21, 2003, now Pat. No. 6,988,730.

(30) Foreign Application Priority Data

Jul. 31, 2002 (JP) ..... 2002-224143

(51) Int. Cl.
*B65H 29/54* (2006.01)

(52) U.S. Cl. ..... 271/306; 271/189; 271/207

(58) Field of Classification Search ..... 271/207, 271/306, 189; 270/58.07

See application file for complete search history.

(56) References Cited

U.S. PATENT DOCUMENTS

| | | | | |
|---|---|---|---|---|
| 5,288,062 | A | 2/1994 | Rizzolo et al. | 270/53 |
| 5,765,826 | A | 6/1998 | Isoda et al. | 271/162 |
| 6,244,591 | B1 | 6/2001 | Paulat | 271/225 |
| 6,302,606 | B1 | 10/2001 | Hayakawa et al. | 400/625 |
| 6,318,718 | B1 | 11/2001 | Ogata et al. | 271/213 |
| 6,325,371 | B1 | 12/2001 | Araki et al. | 271/297 |
| 6,371,479 | B1 | 4/2002 | Osaka et al. | 271/186 |

(Continued)

FOREIGN PATENT DOCUMENTS

EP 1 060 905 A2 12/2000

(Continued)

*Primary Examiner*—Patrick Mackey
*Assistant Examiner*—Kaitlin Joerger
(74) *Attorney, Agent, or Firm*—Fitzpatrick, Cella, Harper & Scinto

(57) ABSTRACT

A sheet post-processing apparatus includes a pair of a conveying upper guide and a conveying lower guide which guides a sheet conveyed by an intermediate roller conveying the sheet, a sheet discharging upper rotating body and a sheet discharging lower rotating body which discharge the sheet on the downstream side of the conveying upper and lower guides, an arm which has the sheet discharging upper rotating body and is displaceable in upward and downward directions, a cam which lifts the arm upward to separate the sheet discharging upper rotating body from the sheet discharging lower rotating body, a stapler which is provided on the downstream side in a sheet conveying direction lower than the intermediate roller and performs processing to the sheet stacked in the conveying lower guide, a link portion which displaces upward the conveying upper guide when the arm is displaced by the cam, and a link lever. In the sheet post-processing apparatus, the stapler, the sheet discharging upper rotating body, and the sheet discharging lower rotating body are orderly placed on the downstream side.

22 Claims, 16 Drawing Sheets

U.S. PATENT DOCUMENTS

| | | | | |
|---|---|---|---|---|
| 6,382,616 | B1 | 5/2002 | Waragai et al. | 270/58.12 |
| 6,988,730 | B2 * | 1/2006 | Fukatsu et al. | 271/306 |
| 2002/0081124 | A1 | 6/2002 | Kuwata et al. | 399/107 |
| 2003/0044209 | A1 | 3/2003 | Isobe et al. | 399/410 |

FOREIGN PATENT DOCUMENTS

| | | |
|---|---|---|
| JP | 58-174965 | 10/1983 |
| JP | 11-60027 | 3/1999 |

* cited by examiner

SHEET CONVEYING APPARATUS, SHEET POST-PROCESSING APPARATUS, AND IMAGE FORMING APPARATUS PROVIDED WITH SHEET CONVEYING APPARATUS AND IMAGE FORMING APPARATUS

This application is a divisional of U.S. patent application Ser. No. 10/622,474, filed on Jul. 21, 2003, now U.S. Pat. No. 6,988,730.

BACKGROUND OF THE INVENTION

1. Field of the Invention

The present invention relates to a sheet conveying apparatus, a sheet post-processing apparatus which performs processing to a sheet, and an image forming apparatus which is provided with the sheet conveying apparatus and the sheet post-processing apparatus and conveys the sheet by the sheet conveying apparatus or forms an image in the sheet and performs the processing to the sheet by the sheet post-processing apparatus, particularly relates to the sheet conveying apparatus which is formed so as to narrow a space in upward and downward directions which a sheet path occupies, the sheet post-processing apparatus, and the image forming apparatus which is provided with the sheet conveying apparatus and the sheet post-processing apparatus.

2. Related Background Art

In the related art, for example, the sheet post-processing apparatus performs alignment, which arrange an end portion of the sheet received from a main body of the image forming apparatus at an intermediate stacking portion, and post-processing at a sheet post-processing portion in which the sheet is bound by, e.g. a stapler and discharges the sheet to stack it. The sheet post-processing portion which is sheet post-processing means, the intermediate roller, a sheet discharging roller, and the like are provided in the intermediate stacking portion. The sheet post-processing portion is placed on the upstream side in a sheet conveying direction higher than the nip of the intermediate roller.

Therefore, in a sheet post-processing mode, the sheet post-processing apparatus in the related art once switchback-conveys the sheet passed through the intermediate roller to the upstream side in a sheet conveying direction, strikes the sheet against a reference wall, and aligns a rear end of the sheet. Then, the sheet post-processing apparatus performs the post-processing to the sheet at that position with the sheet post-processing portion and finally discharges the sheet to a stacking tray with the sheet discharging roller to stack the sheet.

However, in the sheet post-processing apparatus in the related art, since the sheet post-processing portion is provided on the upstream side higher than the intermediate roller, the sheet passed through the intermediate roller is once switchback-conveyed to the upstream side, which results in double provision in a vertical direction of a first sheet path from an entrance of the sheet post-processing apparatus to the intermediate roller and a second sheet path from the reference wall to the sheet discharging roller. Therefore, in the sheet post-processing apparatus, a height of the main body is increased and a size tends to be enlarged.

SUMMARY OF THE INVENTION

It is an object of the invention to provide the sheet post-processing apparatus in which a space in upward and downward directions, which the sheet path occupies, is narrowed.

It is an object of the invention to provide the image forming apparatus having the sheet post-processing apparatus in which a space in upward and downward directions, which the sheet path occupies, is narrowed in the main body.

In order to achieve the above-described object, a sheet post-processing apparatus of the present invention comprises sheet conveying means for conveying a sheet, a conveying upper guide which guides an upper surface of the sheet conveyed by the sheet conveying means and is displaceable in upward and downward directions, a conveying lower guide which opposes to the conveying upper guide on a lower side and supports a lower surface of the sheet conveyed by the sheet conveying means to guide the sheet, a sheet discharging upper rotating body and a sheet discharging lower rotating body which discharge and convey the sheet on a downstream side of the conveying upper guide and the conveying lower guide and are arranged in the upward and downward directions, an arm member which has the sheet discharging upper rotating body and is displaceable in the upward and downward directions, ascending and descending means for lifting the arm member upward to separate the sheet discharging upper rotating body from the sheet discharging lower rotating body, sheet post-processing means provided on the downstream side in a sheet conveying direction lower than the sheet conveying means and performs processing to the sheet stacked in the conveying lower guide, and interlocking means which upward displaces the conveying upper guide when the arm member is displaced upward by the ascending and descending means, wherein the sheet post-processing means, the sheet discharging upper rotating body, and the sheet discharging lower rotating body are orderly arranged on the downstream side in the sheet conveying direction lower than the sheet conveying means.

In order to achieve the above-described object, a sheet post-processing apparatus of the present invention comprises sheet conveying means for conveying a sheet, a conveying upper guide which guides an upper surface of the sheet conveyed by the sheet conveying means and is displaceable in upward and downward directions, a conveying lower guide which opposes to the conveying upper guide on a lower side and supports a lower surface of the sheet conveyed by the sheet conveying means to guide the sheet, a sheet discharging upper rotating body and a sheet discharging lower rotating body which discharge and convey the sheet on a downstream side of the conveying upper guide and the conveying lower guide and are arranged in the upward and downward directions, an arm member which has the sheet discharging upper rotating body and is displaceable in the upward and downward directions, ascending and descending means for lifting the arm member upward to separate the sheet discharging upper rotating body from the sheet discharging lower rotating body, sheet post-processing means provided on the downstream side in a sheet conveying direction lower than the sheet conveying means and performs processing to the sheet stacked in the conveying lower guide, and interlocking means for upward displacing the conveying upper guide when the arm member is displaced upward by the ascending and descending means, wherein the interlocking means upward displaces the conveying upper guide after the arm member is lifted by the ascending and descending means and the sheet discharging upper rotating body is separated from the sheet discharging lower rotating body to be displaced to a position higher than a sheet guiding surface of the conveying upper guide.

In a sheet post-processing apparatus of the invention, an upward displacement distance of the sheet discharging upper rotating body which is displaced by the arm member is set longer than the upward displacement distance of the conveying upper guide.

In a sheet post-processing apparatus of the invention, the interlocking means upward displaces the conveying upper guide after the arm member is lifted by the ascending and descending means and the sheet discharging upper rotating body is separated from the sheet discharging lower rotating body to be displaced to a position higher than a sheet guiding surface of the conveying upper guide.

In a sheet post-processing apparatus of the invention, the interlocking means has a pair of abutting portions which is provided in the conveying upper guide and the arm member and which can be separated from each other, and the pair of abutting portions displaces the conveying upper guide in such a manner that the pair of abutting portions abuts on each other, after the arm member is lifted by the ascending and descending means and the sheet discharging upper rotating body is separated from the sheet discharging lower rotating body to be displaced to a position higher than a sheet guiding surface of the conveying upper guide.

In a sheet post-processing apparatus of the invention, the interlocking means has an elastic body which interlocks the conveying guide with the arm member, and the arm member displaces the conveying upper guide through the elastic body after the arm member is lifted by the ascending and descending means and the sheet discharging upper rotating body is separated from the sheet discharging lower rotating body to be displaced to a position higher than a sheet guiding surface of the conveying upper guide.

In a sheet post-processing apparatus of the invention, an end portion on the downstream side of the conveying upper guide is located higher than a peripheral surface of the sheet discharging upper rotating body when the arm member is located downward, and the end portion on the downstream side of the conveying upper roller is located lower than the peripheral surface of the sheet discharging upper rotating body when the arm member is located upward.

In a sheet post-processing apparatus of the invention, the sheet conveying means, the conveying lower guide, the sheet post-processing means, the sheet discharging upper rotating body, and the sheet discharging lower rotating body are substantially arranged in line.

In a sheet post-processing apparatus of the invention, the ascending and descending means has a cam which displaces the arm member in the upward and downward directions in such a manner that the cam is rotated while the cam is always in contact with the arm member.

A sheet post-processing apparatus of the invention further comprises returning means for rotating the sheet stacked in the conveying lower guide to an upstream side in a sheet conveying direction to return the sheet, wherein the conveying upper guide and the returning means are provided while rotating centers of the conveying upper guide and the returning means are located at the same position.

A sheet post-processing apparatus of the invention further comprises energizing means for energizing the conveying upper guide to a side of the conveying lower guide is provided between the conveying upper guide and the arm member.

In order to achieve the above-described object, a sheet post-processing apparatus comprises sheet conveying means for conveying a sheet, a conveying upper guide which guides an upper surface of the sheet conveyed by the sheet conveying means and is displaceable in upward and downward directions, a conveying lower guide which opposes to the conveying upper guide on a lower side and supports a lower surface of the sheet conveyed by the sheet conveying means to guide the sheet, a sheet discharging upper rotating body and a sheet discharging lower rotating body which discharge and convey the sheet on a downstream side of the conveying upper guide and the conveying lower guide and are arranged in the upward and downward directions, ascending and descending means for separating the sheet discharging upper rotating body from the sheet discharging lower rotating body, and sheet post-processing means provided on the downstream side in a sheet conveying direction lower than the sheet conveying means and performs processing to the sheet stacked in the conveying lower guide, wherein the sheet discharging upper rotating body can be displaced with the conveying upper guide.

In a sheet post-processing apparatus of the invention, the conveying upper guide has an endless belt which can be rotated with the sheet discharging upper rotating body.

A sheet post-processing apparatus of the invention comprises a first processing mode which positions the arm member at a lower position and passes the sheet through the conveying lower guide with the sheet discharging upper rotating body and the sheet discharging lower rotating body to convey the sheet, and a second processing mode which upward displaces the arm member and the sheet discharging upper rotating body, intermediately stacks the predetermined number of sheets in the conveying lower guide at a position where the conveyed sheet is passed through the sheet conveying means, performs the post-processing to the predetermined number of sheets with the sheet post-processing means, displaces downward the arm member, and discharges a bundle of the predetermined number of sheets with the sheet discharging upper rotating body and the sheet discharging lower rotating body.

In order to achieve the above-described object, an image forming apparatus of the invention comprises image forming means for forming an image in a sheet and a sheet post-processing apparatus which performs the post-processing to the sheet in which the image is formed by the image forming means, wherein the sheet post-processing apparatus is one of the above-described sheet post-processing apparatuses.

In a sheet post-processing apparatus of the invention, the sheet post-processing means is placed on the downstream side in the sheet conveying direction lower than the sheet conveying means and the sheet discharging upper rotating body and the sheet discharging lower rotating body are placed on the downstream side of the sheet post-processing means, so that the sheet path from the sheet post-processing means to the sheet discharging upper rotating body and the sheet discharging lower rotating body can be substantially formed in line, the space in the upward and downward directions which the sheet pass occupies can be narrowed, and the height of the sheet post-processing apparatus itself can be lowered.

In the sheet post-processing apparatus of the invention, the sheet discharging upper rotating body can be separated from the sheet discharging lower rotating body and the arm member is interlocked (linked) with the conveying upper guide, so that the sheet post-processing apparatus can lower the sheet discharging upper rotating body and the conveying upper guide to narrow the distance between end portions on the downstream side of the conveying upper guide and the conveying lower guide, surely convey the sheet into the position between the sheet discharging upper rotating body and the sheet discharging lower rotating body, and surely discharge the sheet in the simply stacking mode.

In the sheet post-processing mode, the sheet post-processing apparatus of the invention previously retracts upward the sheet discharging upper rotating body higher than the sheet guiding surface of the conveying upper guide so that the leading end (downstream end) of the sheet does not collide with the peripheral surface of the retracted sheet discharging upper rotating body, and then the sheet post-processing apparatus interlocks (links) the arm member with the conveying upper guide and separates the conveying upper guide from the conveying lower guide, so that the distance in the direction of the sheet thickness can be widely secured while the space in the upward and downward directions which the sheet path occupies is set narrower than ever, and the alignment of the bundle of the sheets can be surely secured.

In a sheet post-processing apparatus of the invention, the central position of the rotation of the conveying upper guide, the arm member, and the sheet discharging upper rotating body are aligned at the same position and the conveying upper guide and the arm member are displaced by the same descending and ascending means, so that the minimum number of constituent components, low cost, and space savings can be realized.

DETAILED DESCRIPTION OF THE PREFERRED EMBODIMENTS

The sheet post-processing apparatus of preferred embodiments of the invention and a laser beam printer (hereinafter referred to as "printer") which is the image forming apparatus including the sheet post-processing apparatus in its main body will be described below referring to the accompanying drawings.

There are printers, copying machines, facsimile machines, and multi function machines in the image forming apparatus. Since the sheet post-processing apparatus of the embodiments of the invention can be provided in the various kinds of image forming machines described above, the sheet post-processing apparatus is provided not only in the printer but in other various kinds of image forming apparatus.

(Printer)

Figure 1:
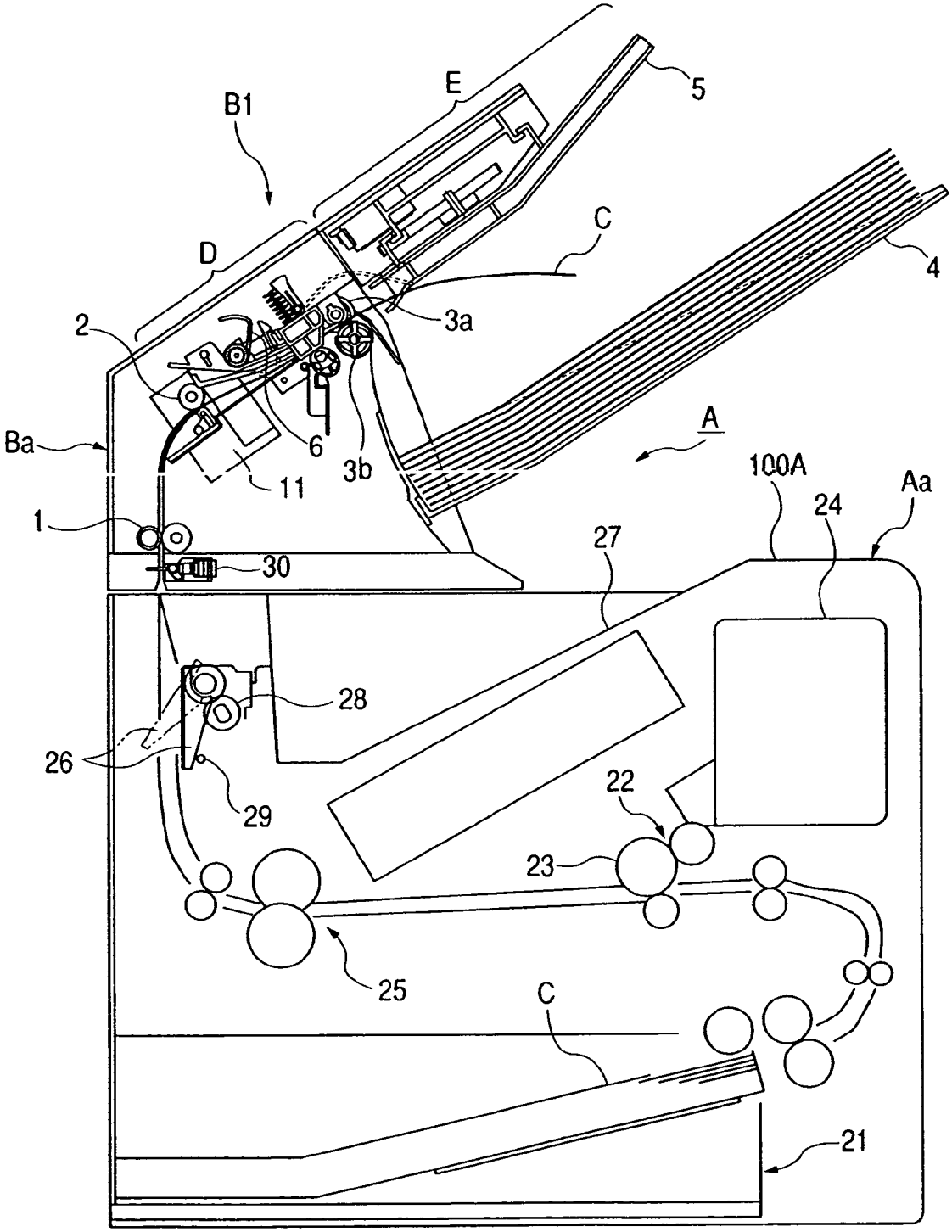
FIG. 1 is a schematically sectional view showing the whole of a configuration of an image forming apparatus such as a printer including a sheet post-processing apparatus of a first embodiment of the invention.

FIG. 1 is the schematically sectional view showing the whole of the configuration of the image forming apparatus, e.g. a printer A including a sheet post-processing apparatus B1 of a first embodiment of the invention.

The sheet post-processing apparatus B1 is placed on an upper portion of a main body Aa as one of constituent components of the printer A.

In the printer A, the main body Aa is solely connected to a computer or connected to a network such as LAN. The printer A forms (prints) an image in the sheet on the basis of image information, a printing signal, or the like, which is transmitted from the computer or the network, by a predetermined image forming process and discharges the sheet. The printer A may be provided with the reading portion which reads an original, duplicate the image of the original into the sheet on the basis of reading information of the reading portion, and discharge the sheet.

The sheet post-processing apparatus B1 directly discharges the sheets conveyed from the main body Aa or binds the sheets by aligning width of the sheet, bundles the sheets, and then staples the sheets with the stapler 11 to discharge the sheets. The discharged sheet or bundled sheets are stacked on a stacking tray 4 with the sheet facing downward.

The sheet post-processing apparatus B1 and the main body Aa are electrically connected with a cable connector (not shown). A casing portion Ba storing each portion of the sheet post-processing apparatus B1 is installed in the main body Aa described in detail later.

The configuration and action of each portion of the main body Aa will be described below along a conveying path of a conveyed sheet C.

The plurality of sheets C is stacked in a sheet feeding cassette 21 of the main body Aa. The plurality of sheets C is orderly fed from the uppermost sheet with the sheet separated by various rollers. In the main body Aa, e.g. an image forming portion 22 which is image forming means for forming a toner image by an image forming process of a laser beam method, the toner image is transferred onto an upper surface of the sheet C fed from the sheet feeding cassette 21 by the predetermined printing signal transmitted from the computer or the network. When the sheet C is conveyed to the image forming portion 22, the toner image has been already formed on a photosensitive drum 23 in the image forming portion 22 by the toner in a cartridge 24.

Then, heat and pressure are applied to the sheet C by a fixing apparatus 25 on the downstream side, and the toner image is fixed. The sheet C in which the image is fixed is selected whether the sheet C is discharged to a face down (FD) discharging portion 27 provided on an upper portion of the main body Aa or to the stacking tray 4 of the sheet post-processing apparatus B1, depending on a position of a flapper 26 of the main body Aa, which is switched on the basis of a control signal from a control portion (not shown).

When the flapper 26 is switched to the position shown by a broken line, the sheet C is guided by the flapper 26 to be returned at an almost U-shaped sheet conveying path to a pair of discharging rollers 28, the image face of the sheet C is reversed, and the sheet C is discharged from the main body Aa to the FD discharging portion 27 by the pair of discharging rollers 28 with the image surface faced downward.

When the staple processing is performed in the stapler 11 on the basis of a command previously output from the computer or the like, before the sheet C to be stapled is conveyed to sheet post-processing apparatus B1, the printer A conveys the sheet C to the sheet post-processing apparatus B1 in such a manner that the flapper 26 is rotated counter-clockwise from the position of the broken line by a solenoid (not shown) and abuts on a stopper 29 to stop on the position of a solid line.

Accordingly, the sheet C is conveyed to an entrance of the sheet post-processing apparatus B1 by the guidance of the flapper 26. The sheet C conveyed to the sheet post-processing apparatus B1 is detected with an entrance sensor 30. Then, the sheet C is conveyed upward with a pair of entrance rollers 1.

Sheet Post-Processing Apparatus of First Embodiment

Figure 2:
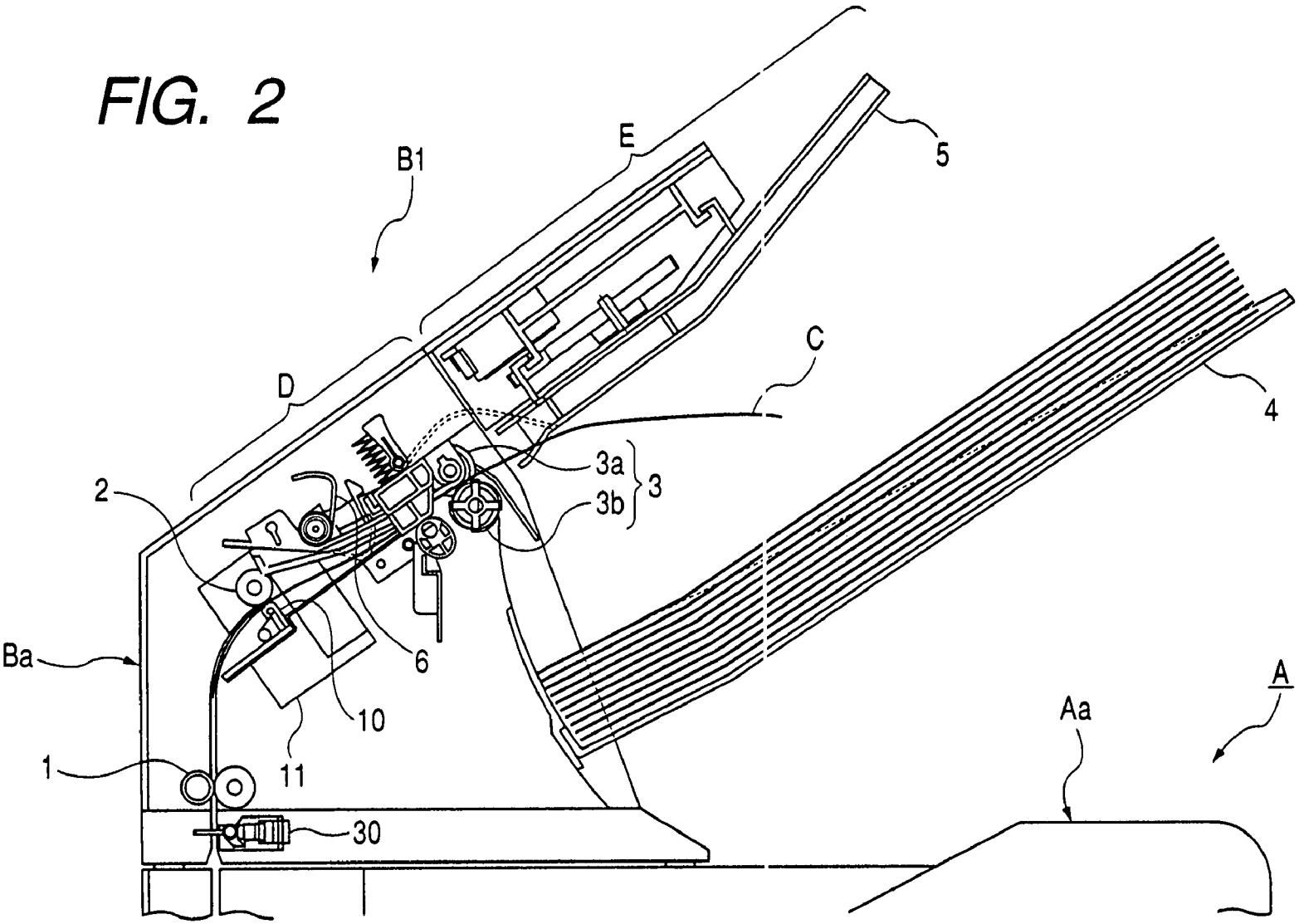
FIG. 2 is a schematically sectional view showing the whole of the configuration of the sheet post-processing apparatus of the first embodiment of the invention.

FIG. 2 is the schematically sectional view showing the whole of the configuration of the sheet post-processing apparatus B1.

The pair of entrance rollers 1 receives the sheet C conveyed from the main body Aa and conveys it to an intermediate roller 2 which is sheet conveying means. The intermediate roller 2 conveys the received sheet C to a pair of sheet discharging rollers 3. The pair of sheet discharging rollers 3 discharges the sheet C to the stacking tray 4.

A jogger 5 aligns edge portions of the sheets (aligns the width of the sheet) along the sheet conveying direction. A puddle 6 aligns a rear end of the sheet in such a manner that the sheet abuts on a reference wall 10. The abutting reference wall 10 for alignment in the conveying direction is almost vertically formed in the vicinity of the intermediate roller 2 described later and on the downstream side of the intermediate roller 2 while the reference wall 10 is directed from a conveying lower guide 9*b*, described later, toward the intermediate roller 2.

An intermediate stacking portion D includes the intermediate roller 2, the puddle 6, the stapler 11 described later, and the like. An alignment portion E includes the jogger 5.

FIG. 2 is the view for illustrating action of a simply stacking mode which is a first processing mode. A sheet discharging upper roller 3*a* of the pair of sheet discharging rollers 3 descends relative to a sheet discharging lower roller 3*b*. In this state, the single sheet C received from the image forming apparatus A is directly discharged by the pair of sheet discharging rollers 3 to be stacked in the stacking tray 4 through the pair of entrance rollers 1 and the intermediate rollers 2 without stopping at the intermediate stacking portion D. The sheet discharging roller 3 is one example of the sheet discharging means. The sheet discharging upper roller 3*a* is one example of a sheet discharging upper rotating body. The sheet discharging lower roller 3*b* is one example of a sheet discharging lower rotating body.

Figure 3:
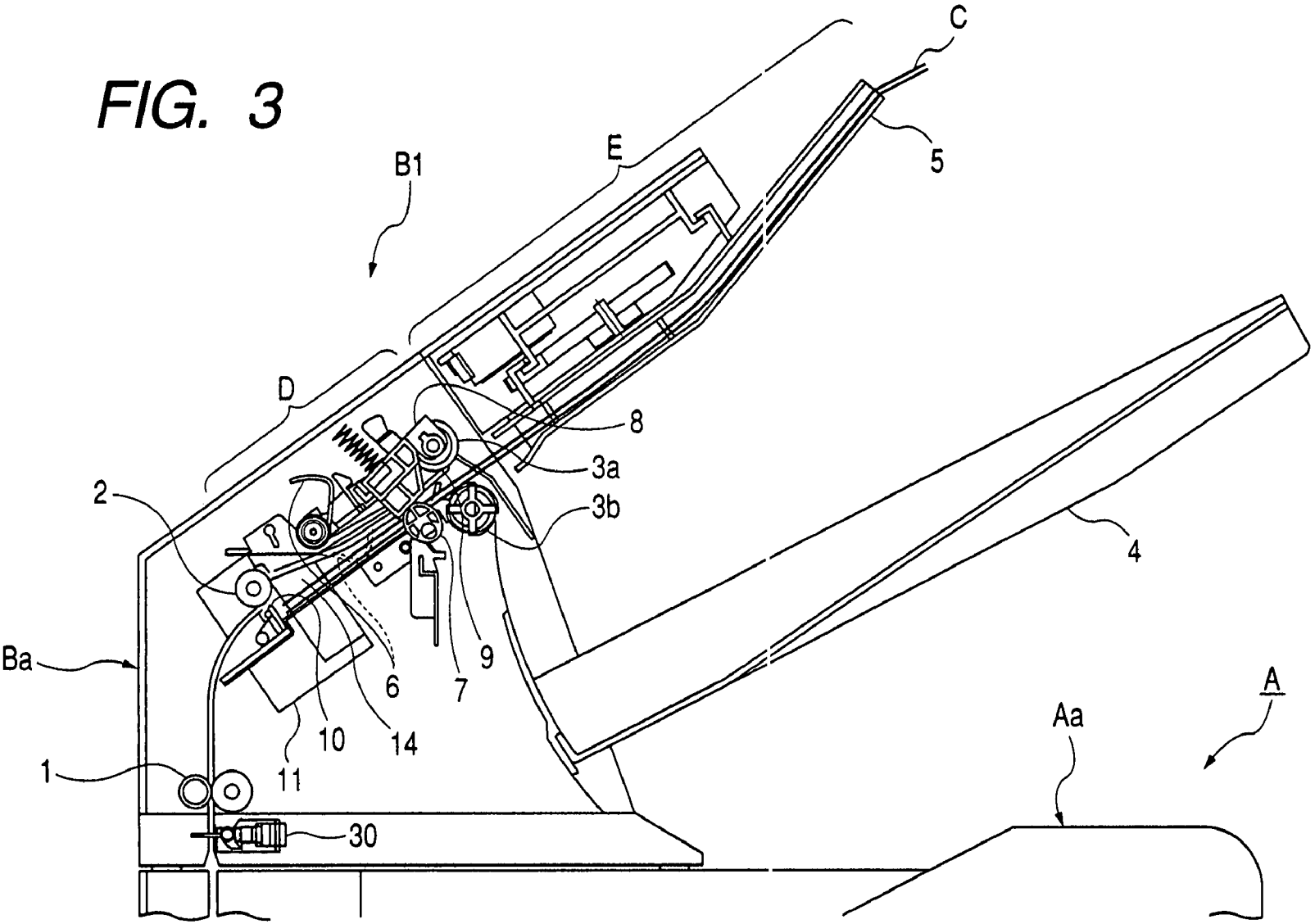
FIG. 3 is a view for illustrating an operation of a sheet post-processing mode which is a second processing mode.

FIG. 3 is the view for illustrating a sheet post-processing mode which is a second processing mode. The sheet discharging upper roller 3*a* in the pair of sheet discharging rollers 3 is separated from the sheet discharging lower roller 3*b*. In this state, the single sheet C received from the image forming apparatus A is guided to the jogger 5 through the pair of entrance rollers 1 and the intermediate rollers 2. After a rear end of the sheet C is passed through the intermediate roller 2, the sheet C is returned in the reverse direction of the sheet conveying direction by, e.g. the puddle 6 which is returning means rotated clockwise from the position of the solid line to the position of the broken line, the sheet abuts on the reference wall 10, and the rear end of the sheet is aligned.

When the upstream side of the conveying lower guide 9*b* is lower than the downstream side of the conveying lower guide 9*b*, sometimes the sheet can slide down toward the upstream side on the sheet discharging lower roller 3*a* by its deadweight and abut on the reference wall 10. Therefore, the puddle 6 is not always required. However, the rear end of the sheet can be surely aligned when the printer A is provided with the puddle 6, compared with the printer A which is not provided with the puddle 6.

The sheet C is aligned in the width direction by the jogger 5 movable in a frontward-backward direction in FIG. 1 and positioned at the predetermined position. Even for the subsequent sheets, the sheet post-processing apparatus B1 performs the same alignment action in the intermediate stacking portion D. After the sheet post-processing apparatus B1 completes the alignment of the desired number of sheets, the rear ends of the sheets are bound by sheet post-processing means, e.g. the stapler 11 provided in the vicinity of the intermediate roller 2 and on the down stream side of the sheet conveying direction.

Figure 4:
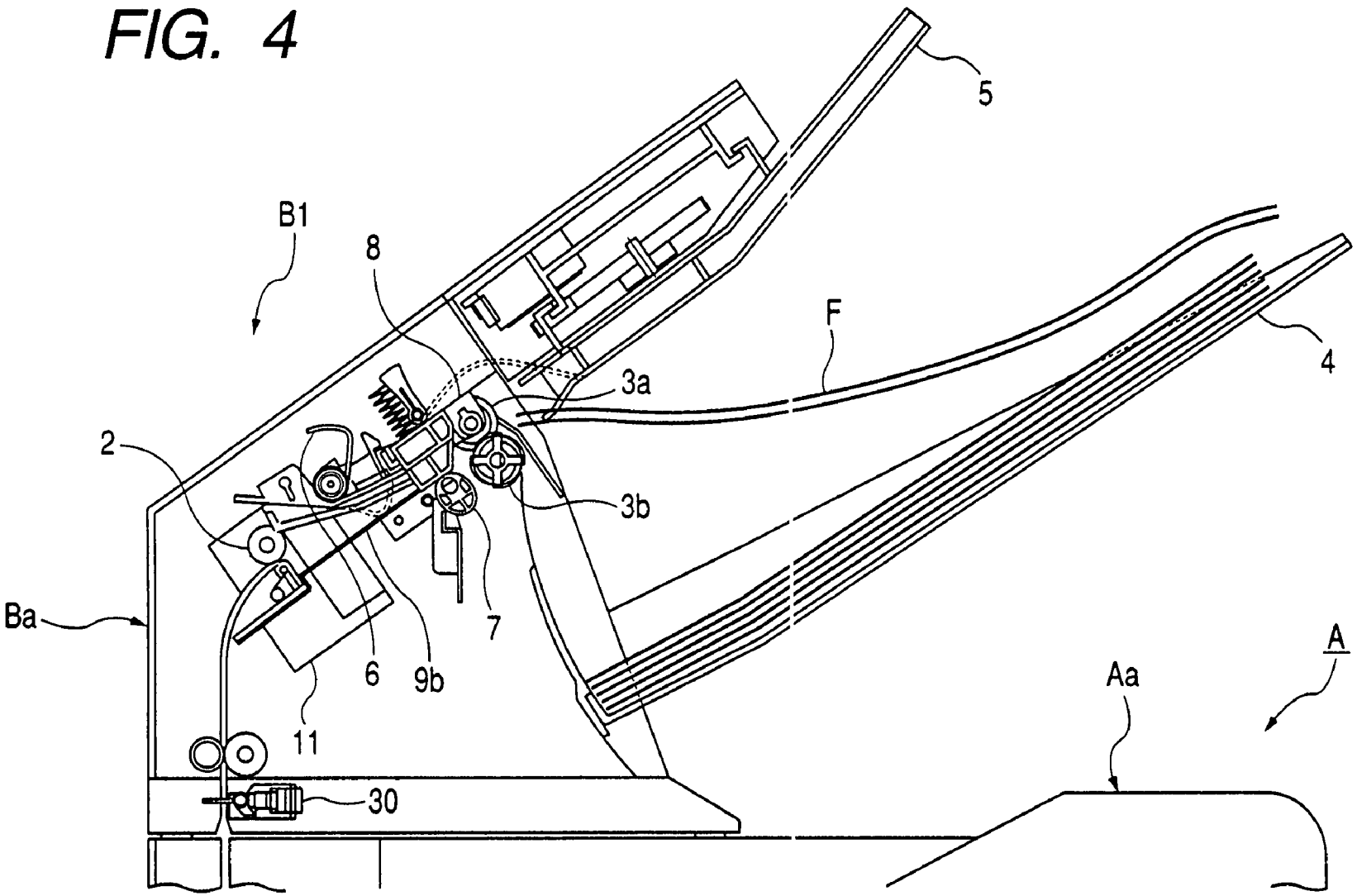
FIG. 4 shows a state in which bound sheets of paper are discharged in the sheet post-processing apparatus of FIG. 2.

As shown in FIG. 4, a bundle of the bound sheets F is put between the sheet discharging upper roller 3*a* and the sheet discharging lower roller 3*b* by the second descent of the sheet discharging upper roller 3*a* and discharged to the stacking tray 4 by the rotation of the sheet discharging rollers 3 to be stacked.

The action of the jogger 5 and the discharging action of the sheet will be described below referring to the perspective view of the sheet post-processing apparatus in FIGS. 5 to 8.

Figure 5:
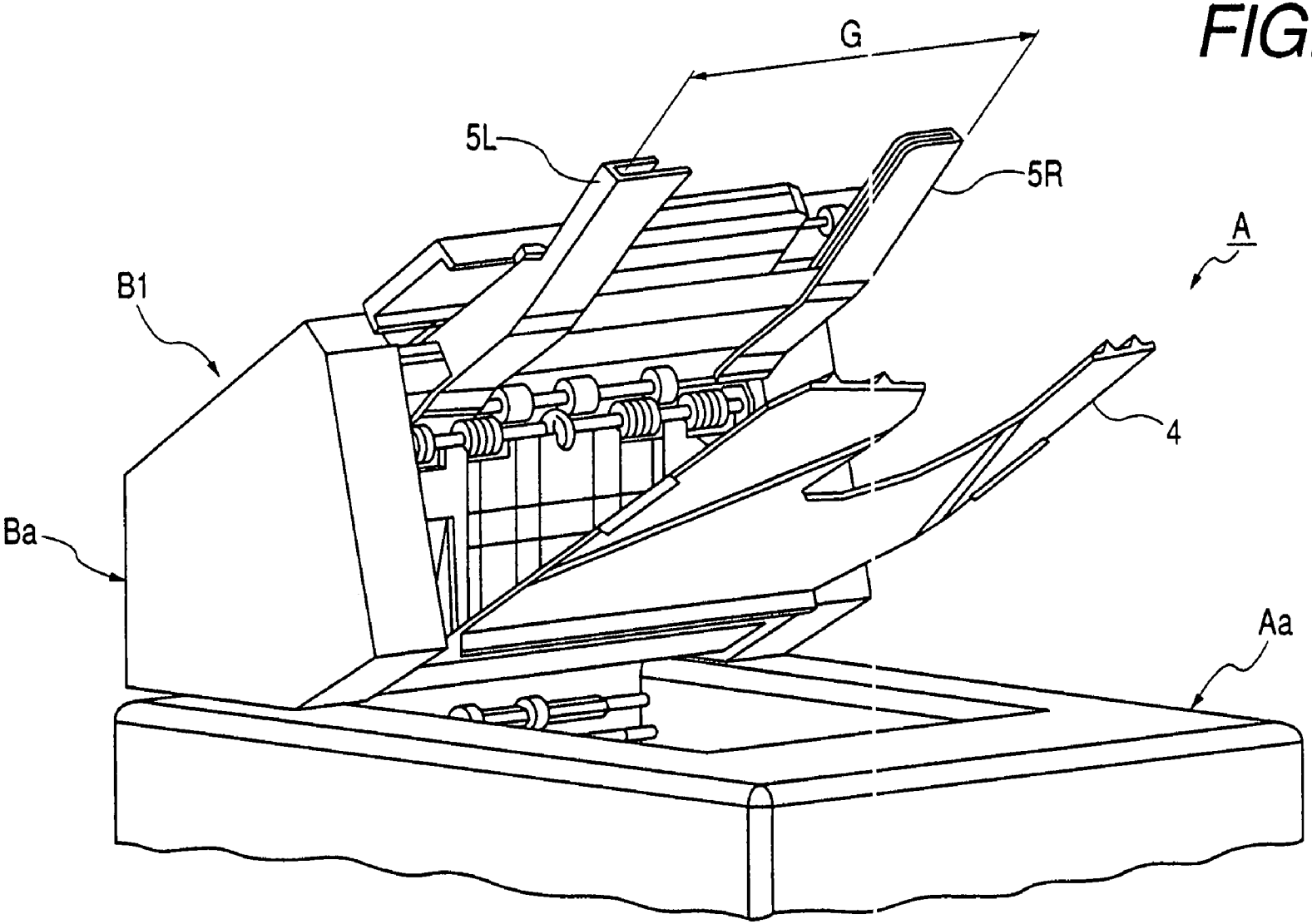
FIG. 5 shows the state which has become the sheet post-processing mode which is the second processing mode in the sheet post-processing apparatus of FIG. 2.
Figure 6:
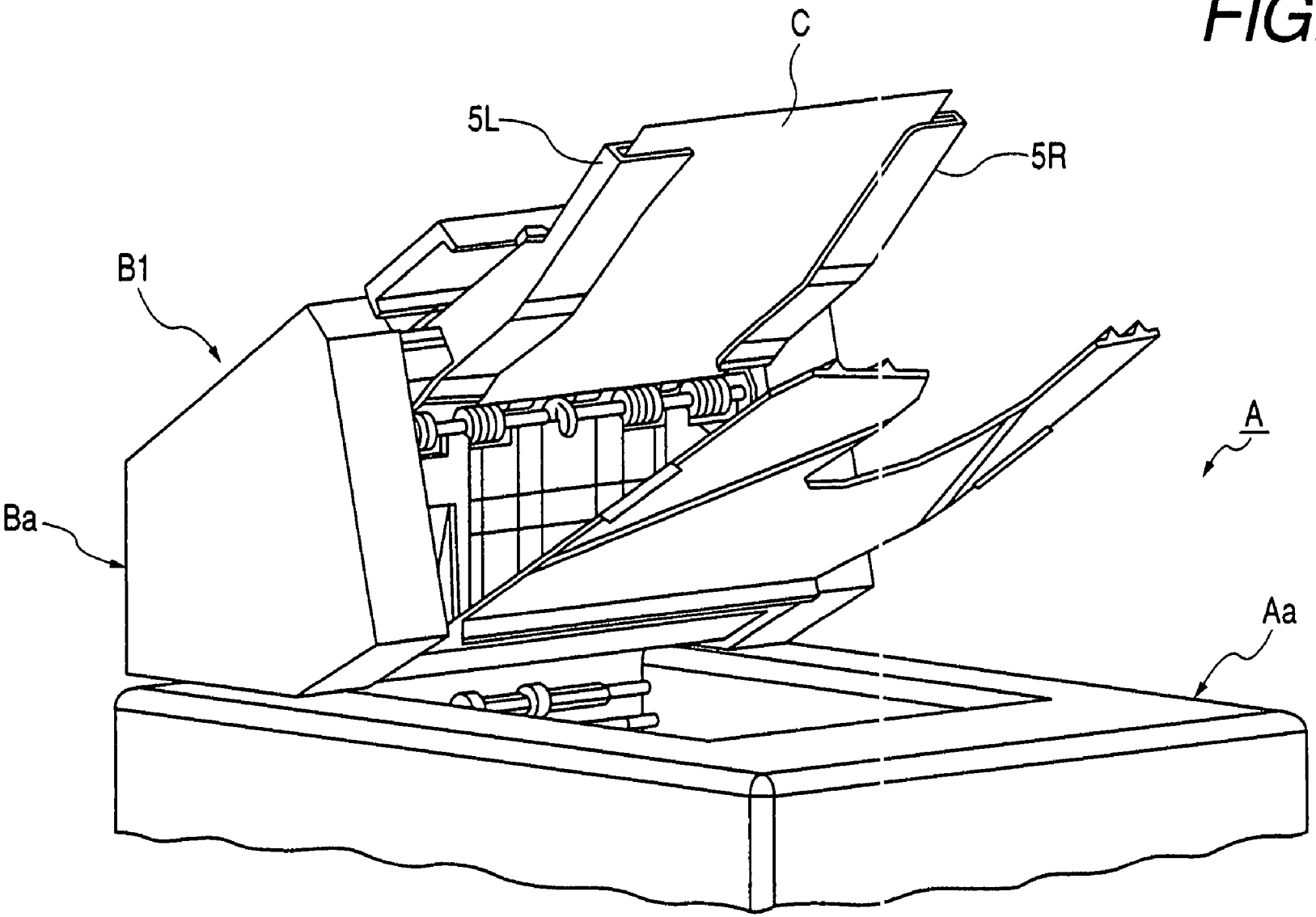
FIG. 6 shows a case in which the sheet is supported with joggers on both sides of the sheet when the state has become the sheet post-processing mode which is the second processing mode in the sheet post-processing apparatus of FIG. 2.

The sheet post-processing apparatus B1 shown in FIG. 5 is in the state which can correspond to the sheet post-processing mode, which is the above-described second processing mode. One jogger 5L of the joggers 5 is on standby for the other jogger 5R while the jogger 5L is opened at a sheet receiving distance G. The discharged sheet from the main body Aa of the sheet post-processing apparatus B1 enters the jogger 5, and as shown in FIG. 6 after the sheet alignment and the post-processing are performed to the sheet, the sheet is discharged with the sheet bound while the sheet is supported by the joggers 5R and 5L.

Figure 7:
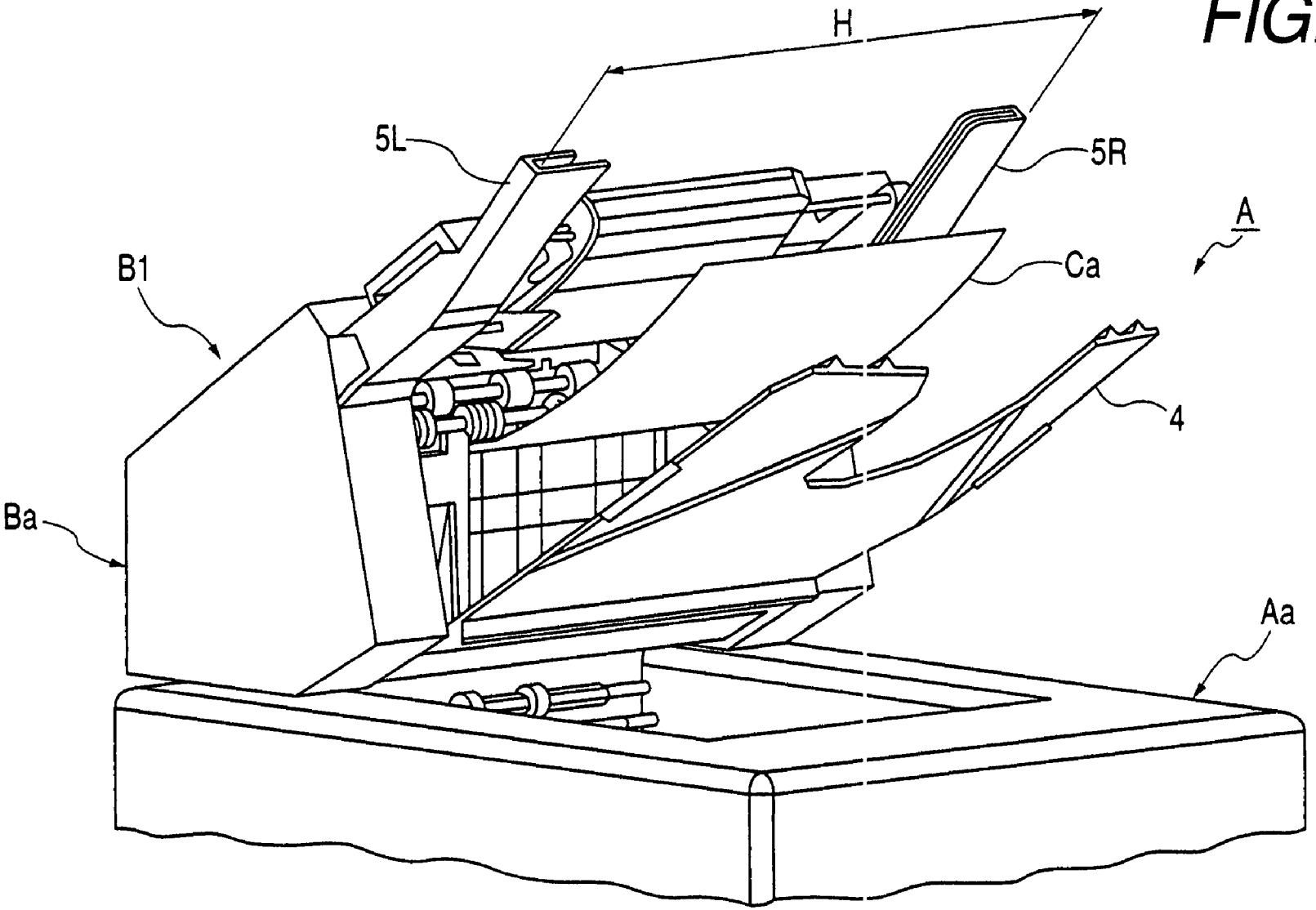
FIG. 7 shows the case in which a distance between the joggers on both sides is widened to drop the sheet when the state has become the sheet post-processing mode which is the second processing mode in the sheet post-processing apparatus of FIG. 2.
Figure 8:
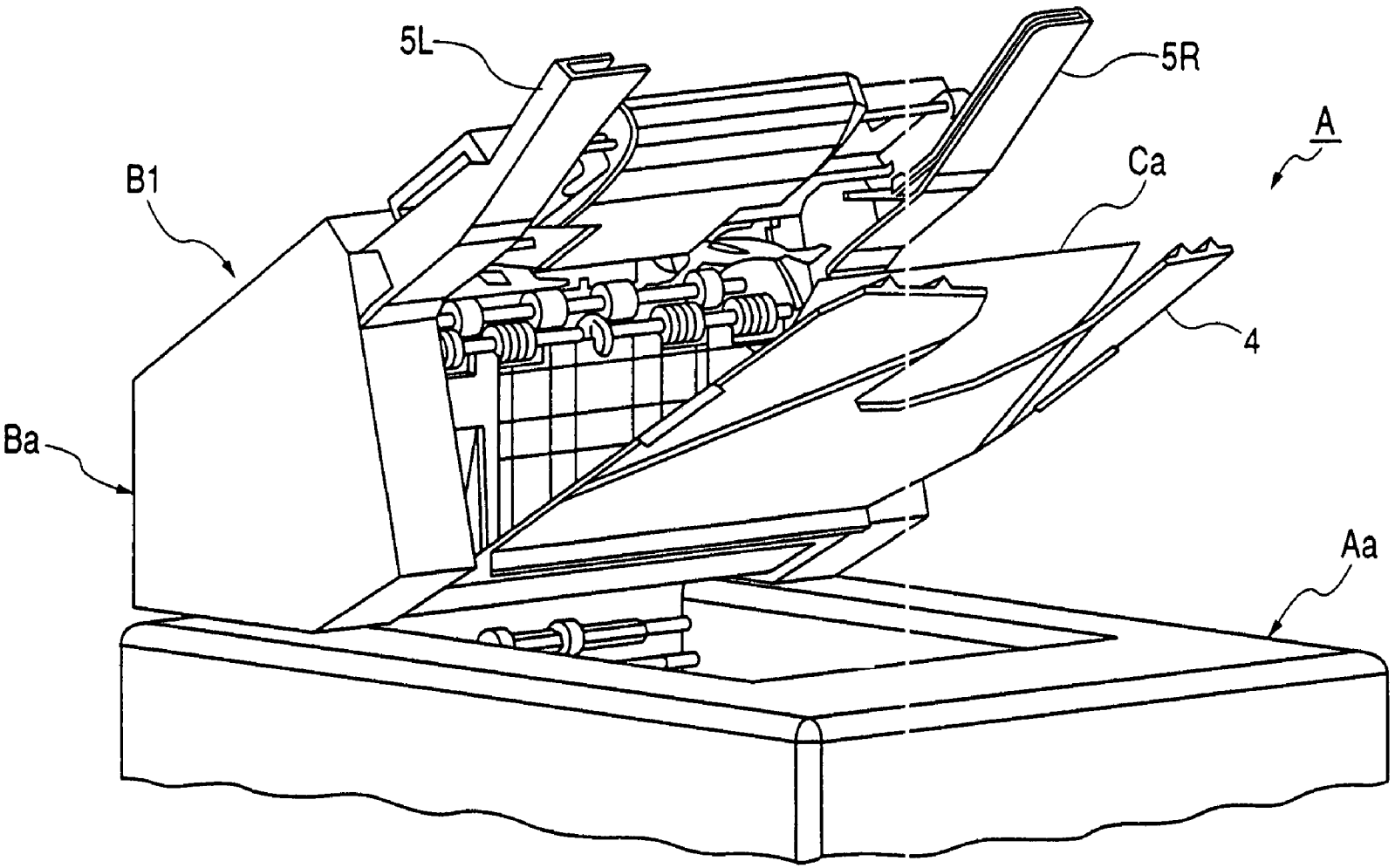
FIG. 8 shows the case in which the distance between the joggers on both sides is widened to drop the sheet on a stacking tray when the state has become the sheet post-processing mode which is the second processing mode in the sheet post-processing apparatus of FIG. 2.

As shown in FIGS. 7 and 8, a sheet Ca is dropped onto the stacking tray 4 to be stacked when the joggers 5L and 5R is widened to a distance H broader than the width of the sheet (in the direction intersecting with the sheet conveying direction at right angles).

Mechanisms of the pair of sheet discharging rollers 3 and a conveying upper guide 9*a* will be described below.

Figure 9:
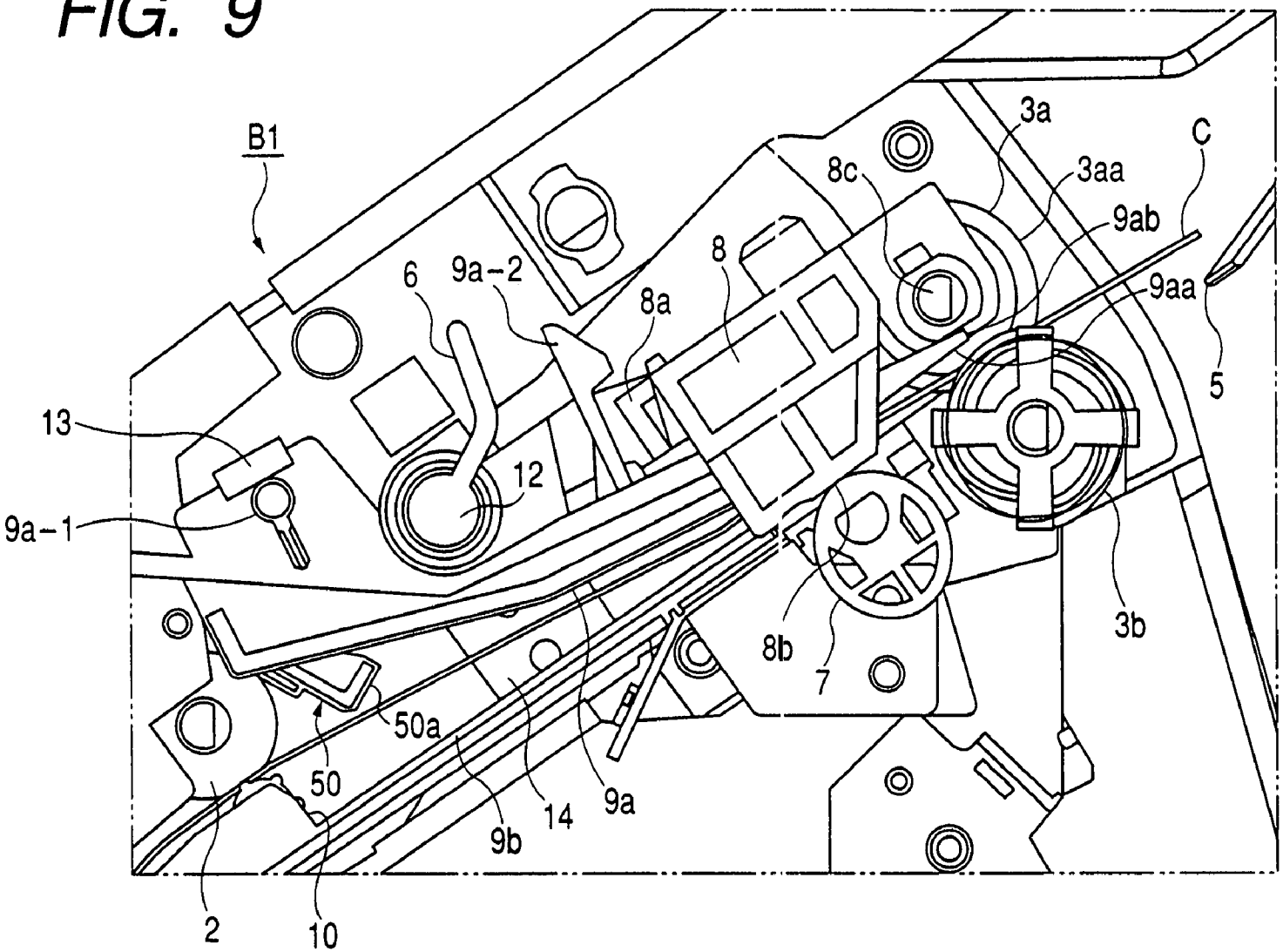
FIG. 9 is an exploded view showing a peripheral portion of a pair of sheet discharging rollers and a conveying upper guide of the sheet post-processing apparatus of the FIG. 2 when the sheet post-processing apparatus becomes the state of a simply stacking mode which is a first processing mode.

FIG. 9 is the exploded view showing the peripheral portion of the pair of sheet discharging rollers 3 and the conveying upper guide 9*a* of the sheet post-processing apparatus B1 when the sheet post-processing apparatus B1 is in the state of the first processing mode.

As described above, in the simply stacking mode, the sheet conveyed from the main body Aa of the printer A to the intermediate stacking portion D is passed through the intermediate portion D and discharged to the stacking tray 4.

An axis of the sheet discharging upper roller 3*a* is rotatably supported on arm members, e.g. bearing portions 8*c* of an arm 8. The axis of the arm 8 is rotatably supported on a fulcrum shaft 12 provided in the casing portion Ba. The conveying upper guide 9*a* is formed so as to guide the upper surface of the sheet, and is upward and downward rotatably supported on the same fulcrum shaft 12 for the arm 8. The conveying lower guide 9*b* supports and guides the lower surface of the sheet. The conveying upper guide 9*a* and the conveying lower guide 9*b* constitute a part of the intermediate stacking portion D. The conveying upper guide 9*a* and the conveying lower guide 9*b* are one example of guiding means.

As shown in FIG. 9, the conveying upper guide 9*a* stops at a home position of FIG. 9 in such a manner that stopper pin 9*a*-1 provided in the conveying upper guide 9*a* abuts on a stopper 13 on the side of the casing portion Ba. A link lever 9*a*-2 is projected toward the upper side of the conveying upper guide 9*a*. The link lever 9*a*-2 is separated from a link portion 8*a* provided in the arm 8 at the state shown in FIG. 9. Accordingly, the arm 8 and the conveying upper guide 9*a* are not in an interlocking state. The link lever 9*a*-2 and the link portion 8*a* are one example of interlocking means, and also one example of the abutting portion.

Ascending and descending means, e.g. a cam 7 always abuts on a lower surface 8*b* of the arm 8. The cam 7 shown in FIG. 9 lowers and stops the arm 8 and the sheet discharging upper roller 3*a* whose axis is supported on the arm 8 at the lowermost position.

The sheet discharging upper roller 3*a* and the sheet discharging lower roller 3*b* mutually enter the position between rollers, put the sheet between the rollers in the shape of a wave and rotate toward the sheet conveying direction. At this point, a peripheral surface 3*aa* of the sheet discharging upper roller 3*a* is projected downward from a sheet guiding surface 9*aa* of the lower surface of the conveying upper guide 9*a*.

Accordingly, the sheet rushes into the peripheral surface of the pair of sheet discharging rollers 3, and the sheet is formed in the shape of the wave by the sheet discharging upper roller 3*a* and the sheet discharging lower roller 3*b* and nip-conveyed to be directly simply discharged to the stacking tray 4. The plurality of sheet discharging upper rollers 3*a* and sheet discharging lower rollers 3*b* are alternately arranged in the direction of the rotating axis. However, the plurality of sheet discharging upper rollers 3*a* and sheet discharging lower rollers 3*b* are arranged at the position where the sheet discharging upper roller 3*a* and the sheet discharging lower roller 3*b* are in contact with each other without alternately arranging the plurality of sheet discharging upper rollers 3*a* and the sheet discharging lower rollers 3*b*, and the sheet may be conveyed at the flat state to be discharged without forming the sheet in the shape of the wave.

Figure 10:
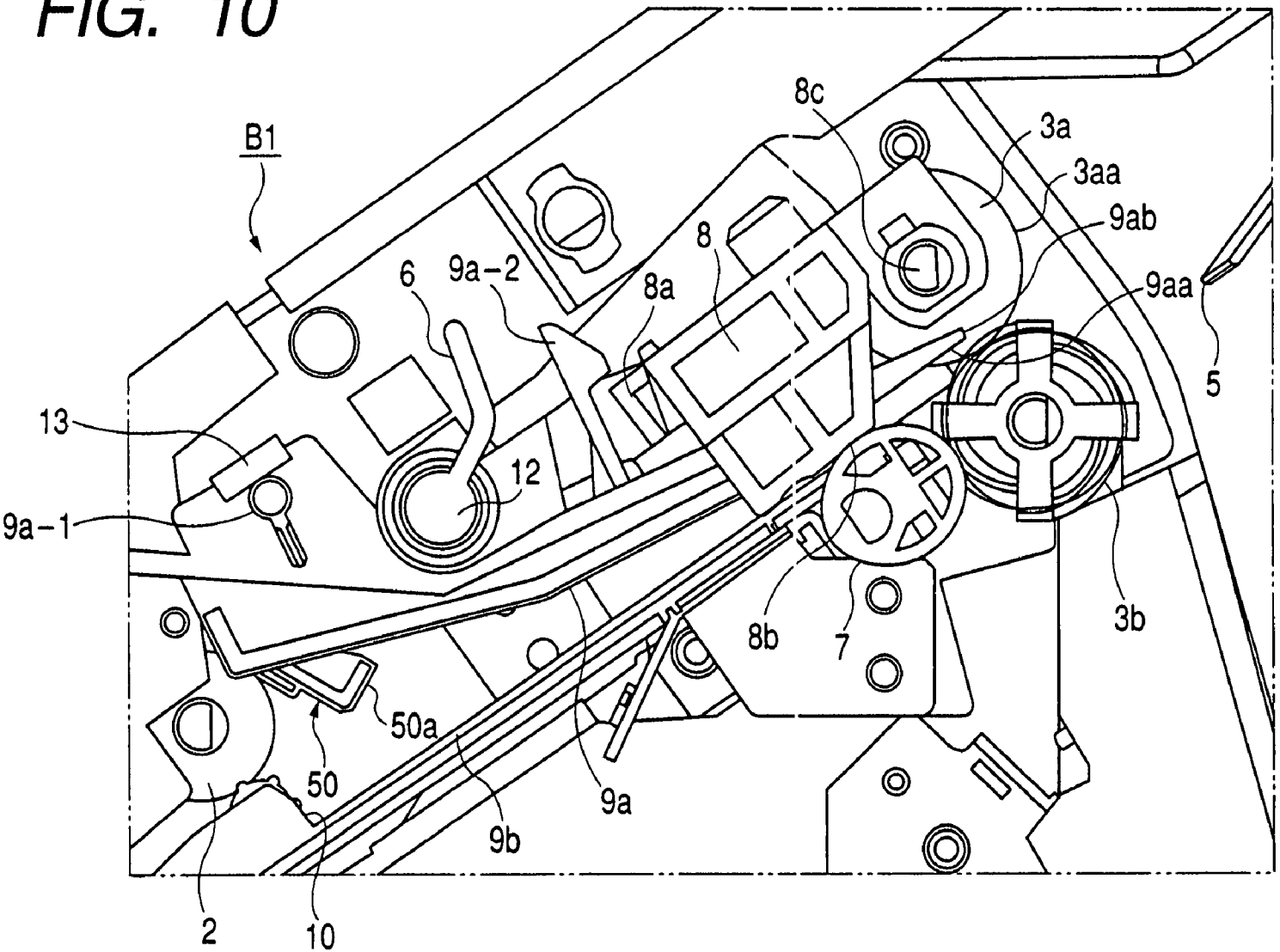
FIG. 10 shows the state in which a cam starts to rotate counterclockwise in FIG. 9.
Figure 11:
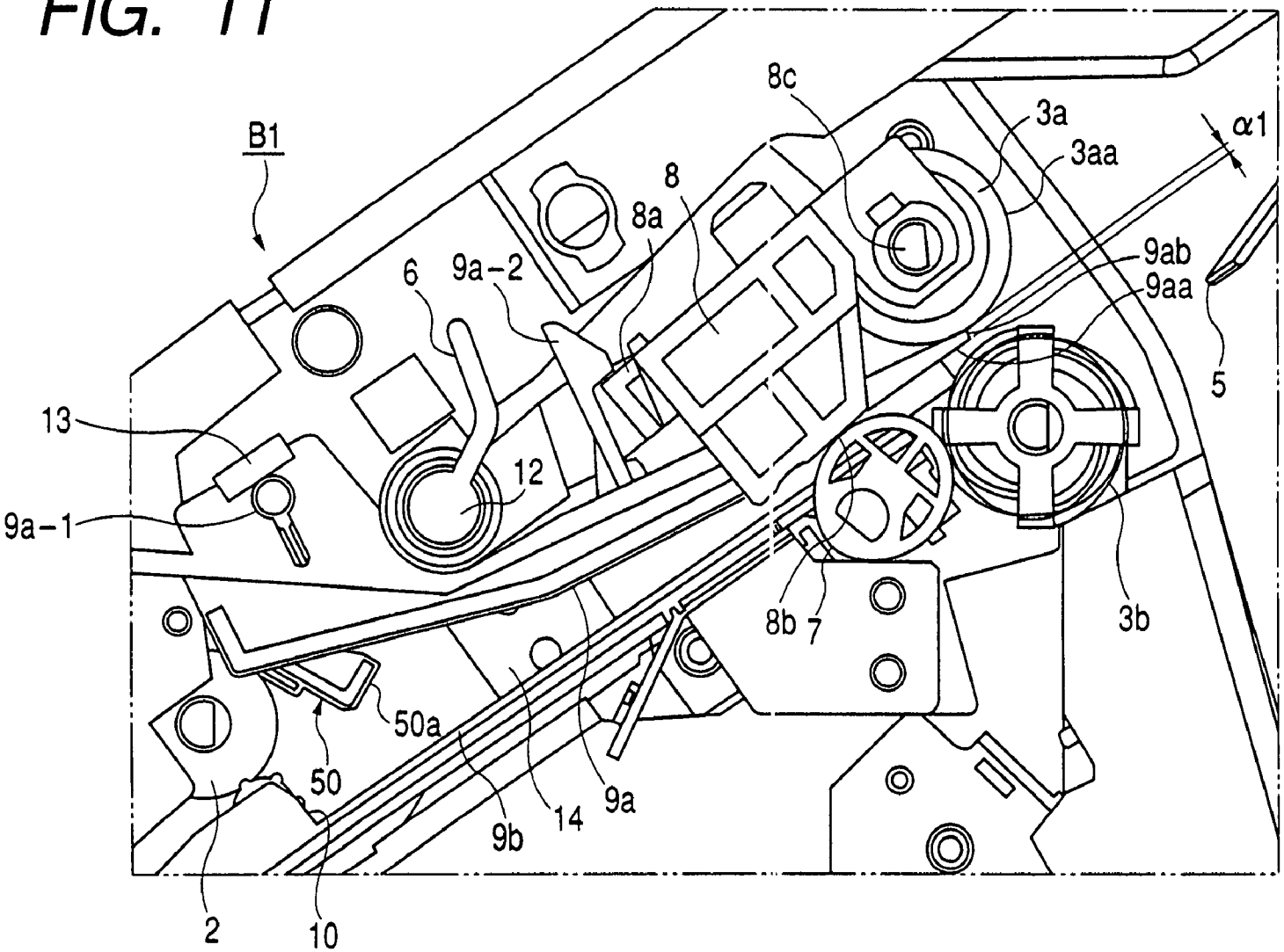
FIG. 11 shows the state in which the cam further rotates counterclockwise in FIG. 10.
Figure 12:
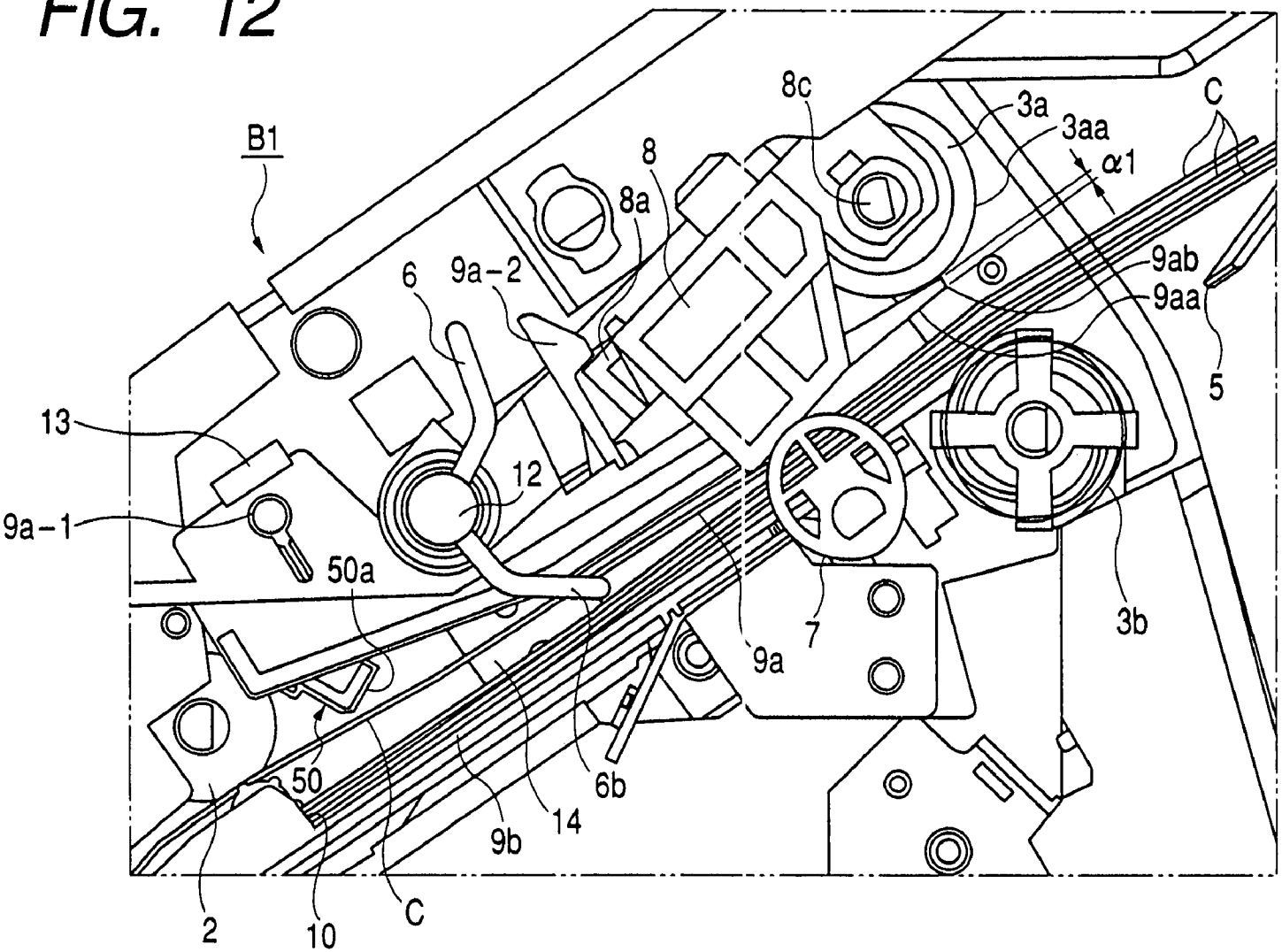
FIG. 12 shows the state in which the cam further rotates counterclockwise in FIG. 11.

FIGS. 10 to 12 are the view for illustrating the action of the arm 8 and the conveying upper guide 9*a* when the cam 7 rotates counterclockwise in figures. FIG. 10 shows the state in which the cam 7 starts to rotate counterclockwise. A descending distance of the sheet discharging upper roller 3*a* moved upward by the arm 8 is set loner than an upward rotating distance of the conveying upper guide 9*a*.

By the rotation of the cam 7, the lower surface 8*b* of the arm 8 is pressed upward to start to rotate upward about the fulcrum shaft 12. At this point, the sheet discharging upper roller 3*a* whose axis is supported on the arm 8 also integrally moves upward and starts to separate from the sheet discharging lower roller 3*b*. However, the conveying upper guide 9*a* whose axis is supported on the same fulcrum shaft 12 for the arm 8 does not become the state in which the conveying upper guide 9*a* is interlocked with the arm 8 (the conveying upper guide 9*a* does not become the state in which the conveying upper guide 9*a* starts the link), because there is still a space between the link portion 8*a* of the arm and the link lever 9*a*-2. Therefore, only the arm 8 and the sheet discharging upper roller 3*a* continues the upward movement in which the arm 8 and the sheet discharging upper roller 3*a* separate from the sheet discharging lower roller 3*b*. At this stage, the peripheral surface 3*aa* of the sheet discharging upper roller 3*a* is projected downward from the sheet guiding surface 9*aa* of the conveying upper guide 9*a*.

FIG. 11 shows the state in which the cam 7 further rotates counterclockwise in the figure. By the rotation of the cam 7, the link portion 8*a* of the arm 8 comes into contact with the link lever 9*a*-2 of the conveying upper guide 9*a* and then the conveying upper guide 9*a* also rotates upward with the upward rotation of the arm 8. That is to say, the arm 8 and the conveying upper guide 9*a* become the link state. At this stage, the peripheral surface 3*aa* of the sheet discharging upper roller 3*a* is retracted upward by a distance $\alpha$1 from the sheet guiding surface 9*aa* of the conveying upper guide 9*a*. Then, while the sheet discharging upper roller 3*a* and the conveying upper guide 9*a* are held at this positional relationship (at the linked state), the sheet discharging upper roller 3*a* and the conveying upper guide 9*a* rotate upward. The sheet discharging upper roller 3*a* separates from the sheet discharging lower roller 3*b*, and the conveying upper guide 9*a* separates from the conveying lower guide 9*b*.

FIG. 12 shows the state in which the cam 7 further rotates counterclockwise in the figure. The arm 8 and the sheet discharging upper roller 3*a* finish the rotation at the state shown in FIG. 12. Even in this case, the peripheral surface 3*aa* of the sheet discharging upper roller 3*a* is retracted upward by a distance $\alpha$1 from the sheet guiding surface 9*aa* of the conveying upper guide 9*a*. Thus, the sheet post-processing apparatus B1 receives the sheet from the image forming apparatus while the sheet discharging upper roller 3*a* is farthest from the sheet discharging lower roller 3*b* and the conveying upper guide 9*a* is farthest from the conveying lower guide 9*b*.

As described above, in the sheet post-processing apparatus B1 of the embodiment, when the sheet discharging upper roller 3*a* ascends and completely separates from the sheet discharging lower roller 3*b*, the interlocking mechanism (linking configuration) between the arm and the conveying upper guide 9*a*, which is the reverse state of the positional relationship between the peripheral surface 3*aa* of the sheet discharging upper roller 3*a* and the sheet guiding surface 9*aa* of the conveying upper guide 9*a*, was described.

In the sheet post-processing mode, the conveyed sheet C is passed through the intermediate roller 2 and stacked on the conveying lower guide 9*b*, which is the intermediate stacking portion D. The puddle 6 rotates clockwise from the position shown by a reference numeral 6*a* to the position shown by a reference numeral 6*b* as shown in FIG. 12, comes into contact with the sheet at position shown by the reference numeral 6*b*, and move the sheet to the upstream side of the conveying direction. The puddle 6 performs the longitudinal alignment of the sheet while the rear end of the sheet abuts on the reference wall 10. Then, the puddle 6 continues the clockwise rotation and returns to the home position 6*a*. After the rear end of the sheet abuts on the reference wall 10, the lateral alignment of the sheet is performed by the jogger 5.

In the sheet post-processing apparatus B1, after the above-described actions are repeatedly performed and the alignment of the predetermined number of sheets is performed, the predetermined number of sheets is bound with the stapler 11 to make a bundle of sheets.

Then, the cam 7 continues the counterclockwise rotation, rotates from the position shown in FIG. 12 to the initial position shown in FIG. 9, and the lowers the arm 8 and the sheet discharging upper roller 3*a*. Accordingly, the conveying upper guide 9*a* also rotates downward and stops at the position where the conveying upper guide 9*a* does not move downward lower than the peripheral surface 3*aa* of the sheet discharging upper roller 3*a*. The pair of sheet discharging rollers 3 discharges the bundle of the sheets to the stacking tray 4 to stack it.

When the rear end of the bundle of the sheets is passed through the pair of sheet discharging rollers 3, since the initial sheet of the next bundle of the sheets is conveyed into the intermediate stacking portion D by the intermediate roller 2, the cam 7 rotates counterclockwise in the figure again, and the peripheral surface 3*aa* of the sheet discharging upper roller 3*a* is retracted upward from the sheet guiding surface 9*aa* of the conveying upper guide 9*a* while the arm 8, the sheet discharging upper roller 3*a*, and the conveying upper guide 9*a* move upward.

The start of the rotation of the cam 7 may be immediately after the rear end of the bundle of the sheets is passed through the pair of sheet discharging rollers 3 and the initial sheet of the next bundle of the sheets enters the jogger 5 from the intermediate stacking portion D by the pair of sheet discharging rollers 3. The reason why only the initial sheet is conveyed by the pair of sheet discharging rollers 3 is that the bundle of the sheets surely gets over a gap between the intermediate stacking portion D and the jogger 5 by the pair of sheet discharging rollers 3. In conveying the sheet after the initial sheet, though the sheet discharging upper roller 3*a* completely separates from the sheet discharging lower roller 3*b*, the gap does not become an obstacle to the conveying of the sheet because the initial sheets acts as a bridge to the next sheet.

Figure 13:
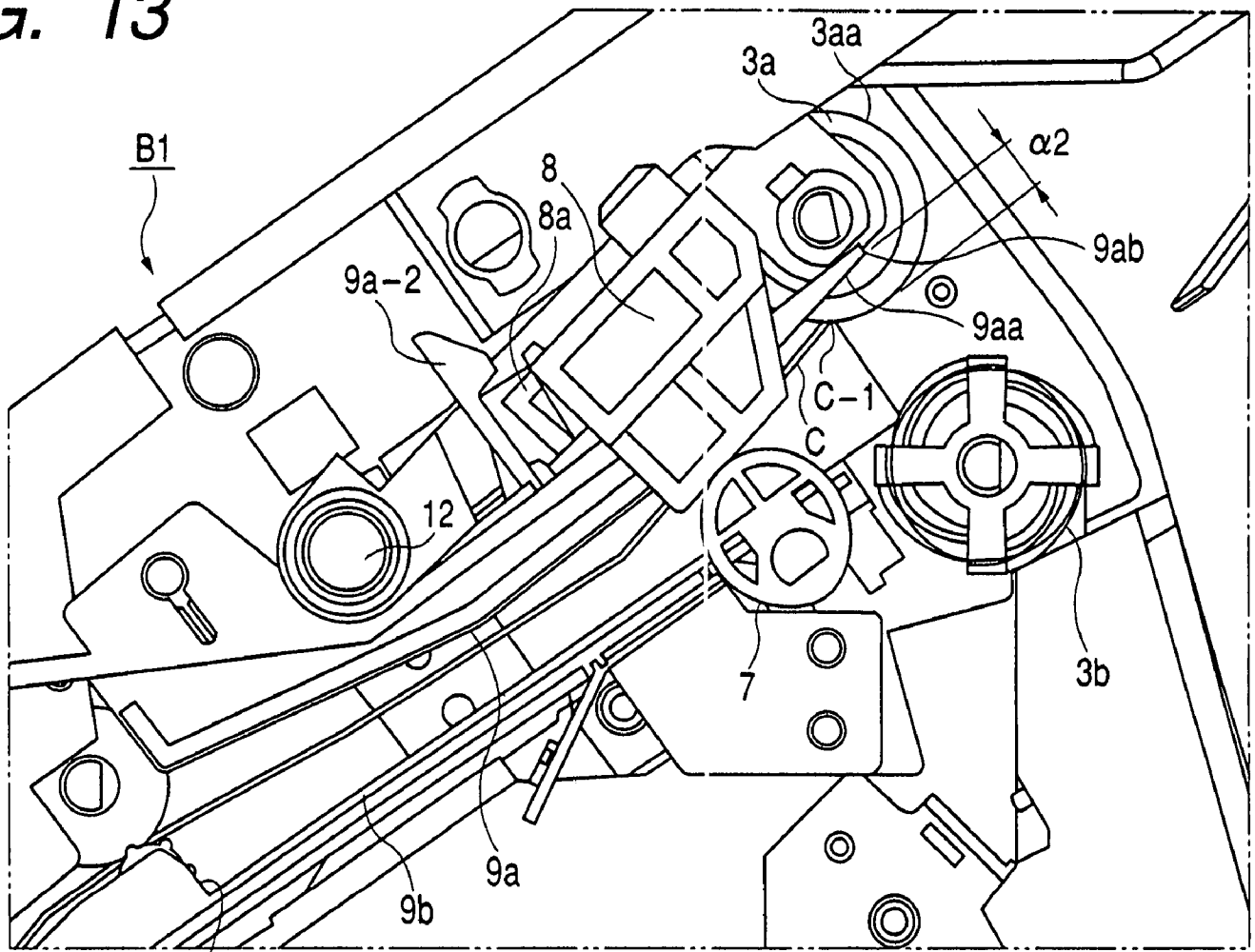
FIG. 13 is a view for illustrating a relative positional relationship between the sheet discharging upper roller and a conveying upper guide when a sheet discharging upper roller ascends and conveyance of the sheet is not smoothly performed.

FIG. 13 is the view for illustrating the relative positional relationship between the sheet discharging upper roller 3*a* and the conveying upper guide 9*a* when the sheet discharging upper roller 3*a* ascends and the conveying of the sheet is not smoothly performed.

FIG. 13 shows the state in which the sheet discharging upper roller 3*a* has completed the separation from the sheet discharging lower roller 3*b* while the peripheral surface 3*aa* of the sheet discharging upper roller 3*a* is projected downward by a distance $\alpha 2$ from the sheet guiding surface 9*aa* of the conveying upper guide 9*a*. In the sheet C conveyed into this state, a leading end C-1 hooks on the peripheral surface 3*aa* of the sheet discharging upper roller 3*a* and moves jerkily, there is a fear of a paper jam between the conveying upper guide 9*a* and the conveying lower guide 9*b* However, in the sheet post-processing apparatus B1 of the embodiment, as described above, since the sheet guiding surface 9*aa* of the conveying upper guide 9*a* is located at the position lower than the peripheral surface 3*aa* of the sheet discharging upper roller 3*a*, the sheet is never jammed between the conveying upper guide 9*a* and the conveying lower guide 9*b*.

As described above, in the sheet post-processing apparatus B1 of the embodiment, since the stapler 11 is placed on the downstream side more than the nip of the intermediate roller 2 and the pair of sheet discharging rollers 3 is placed on the downstream side of the stapler 11, the intermediate stacking portion D which is formed with a sheet path 14 from the intermediate roller 2 to the pair of sheet discharging rollers 3 can be made almost a line-shaped straight path and the space in the upward and downward directions can be narrowed. That is to say, compared with the related art, the height of the apparatus itself can be lowered by narrowing the space in the upward and downward directions which the sheet path 14 occupies.

By making the sheet path 14 in form of the straight path, the simply stacking mode and the sheet post-discharging mode can be performed on the same straight path, so that the action of the sheet post-processing apparatus can be simplified.

In the simply stacking mode, the sheet post-processing apparatus B1 of the embodiment can lower the sheet discharging upper roller 3*a* and the conveying upper guide 9*a* to narrow the distance between leading ends (end portions on the downstream side) 9*ab* and 9*bb* of the conveying upper guide 9*a* and the conveying lower guide 9*b*, surely convey the leading end of the sheet into the nip of the pair of sheet discharging rollers 3, and surely discharge the sheet.

In the sheet post-processing mode, the sheet post-processing apparatus B1 of the embodiment previously retracts upward the sheet discharging upper roller 3*a* higher than the sheet guiding surface 9*aa* of the conveying upper guide 9*a* so that the leading end of the sheet does not collide with the peripheral surface 3*aa* of the retracted sheet discharging upper roller 3*a*, and then the sheet post-processing apparatus B1 link the arm 8 with the conveying upper guide 9*a* and separates the conveying upper guide 9*a* from the conveying lower guide 9*b*, so that the space in the upward and downward directions which the sheet path 14 occupies can be set narrower than ever, a processing space having the wide distance in the direction of the sheet thickness can be secured, and the alignment of the bundle of the sheets can be surely secured.

In the sheet post-processing apparatus B1 of the embodiment, the axes of the main components (the conveying upper guide 9*a*, the arm 8, and the sheet discharging upper roller 3*a*) constituting a movable portion of the sheet path in the intermediate stacking portion D are supported on the fulcrum shaft 12 which is the common central position of the rotation and the main components can be moved by the same cam 7, so that the movable portion of the intermediate stacking portion D can be realized with the minimum number of constituent components, low cost, and space savings.

The height of the printer which is equipped with the sheet post-processing apparatus having the low height in the main body can be also lowered.

Sheet Post-Processing Apparatus of Second Embodiment

Figure 14:
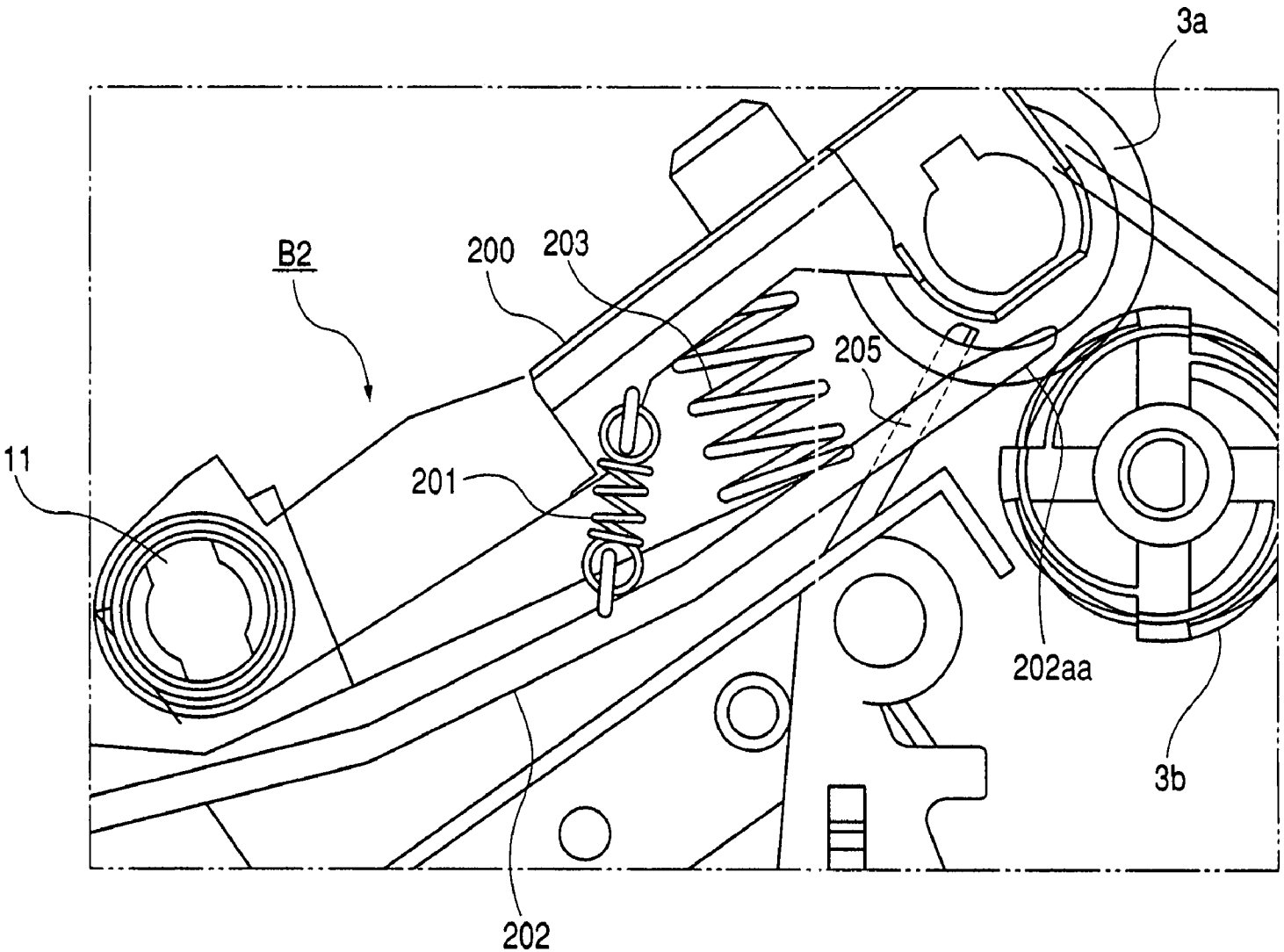
FIG. 14 shows a main part of the sheet post-processing apparatus of a second embodiment.

FIG. 14 shows the main part of the sheet post-processing apparatus of a second embodiment.

In the sheet post-processing apparatus B1 of the first embodiment, the arm 8 is interlocked with the conveying upper guide 9*a* in such a manner that the link portion 8*a* abuts on the link lever 9*a*-2. However, in a sheet post-processing apparatus B2 of the second embodiment, the arm is interlocked with the conveying upper guide with a tension spring 201 which is the interlocking means and an elastic body. The configurations of the sheet post-processing apparatuses of the both embodiments are different in this point and the other configurations are the same, so that only different portions will be described.

Figure 15:
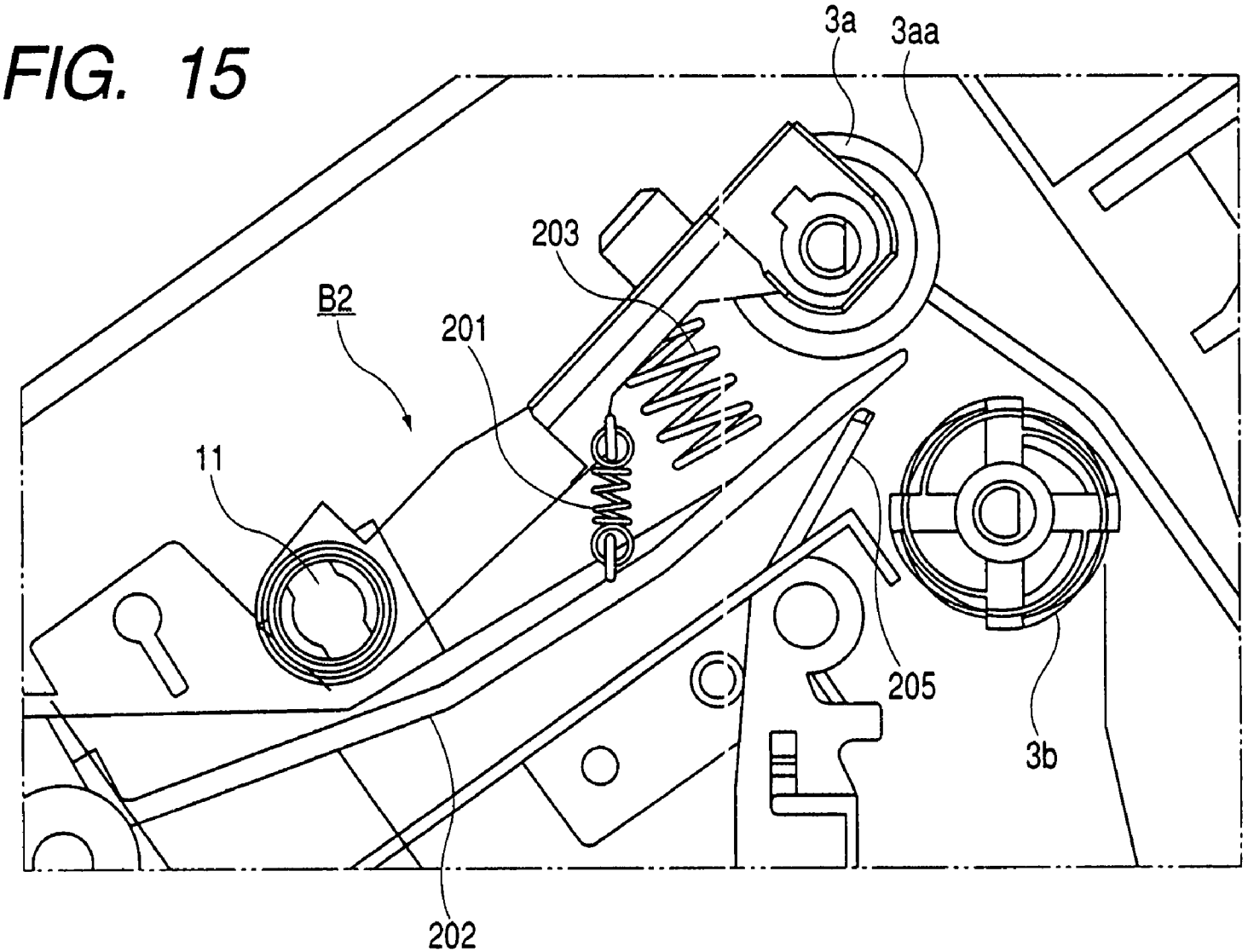
FIG. 15 shows the state in which a conveying upper guide is pulled by a tension spring and rotated upward.

In FIG. 14, the axis of the sheet discharging upper roller 3*a* is supported on an arm 200. In the sheet post-processing apparatus B2, when the arm 200 is rotated upward by the rotation of a cam (not shown) having the same shape as that of the cam 7 in the sheet post-processing apparatus B1 of the first embodiment and the sheet discharging upper roller 3*a* separates from the sheet discharging lower roller 3*b*, as shown in FIG. 15, a conveying upper guide 202 is pulled by the tension spring 201 and rotated upward.

When the arm 200 is rotated downward, since the tension spring 201 does not upward pull the conveying upper guide 202, the interlocking state between the arm 200 and the conveying upper guide 202 is released. The arm 200 presses the conveying upper guide 202 with a compression spring 203 placed near the midpoint of the arm 200 and stops at the position shown in FIG. 14. That is to say, in the conveying upper guide 202, the stopper pin 9*a*-1 abuts on the stopper 13 to prevent the downward rotation as shown in FIG. 9. At this point, the peripheral surface 3*aa* of the sheet discharging upper roller 3*a* is projected downward from a lower surface 202*aa* of the conveying upper guide 202. Thus, in the sheet post-processing apparatus B2 of the second embodiment, the positional relationship between the conveying upper guide 202 and the peripheral surface 3*aa* of the sheet discharging upper roller 3*a* is the same as that of the sheet post-processing apparatus B1 of the first embodiment.

In the sheet post-processing apparatus B2 of the second embodiment, in addition to the achievement of the same effect as that of the sheet post-processing apparatus B1 of the first embodiment, since the conveying upper guide 202 is pressed downward by energizing means, e.g. the compression spring 203 in the downward rotation of the arm 200, the conveying upper guide 202 is surely lowered, and the conveying upper guide 202 is not lifted by the sheet even if the sheet enters the conveying upper guide 202, the conveyance in the simply stacking mode can be improved.

Sheet Post-Processing Apparatus of Third Embodiment

Figure 16:
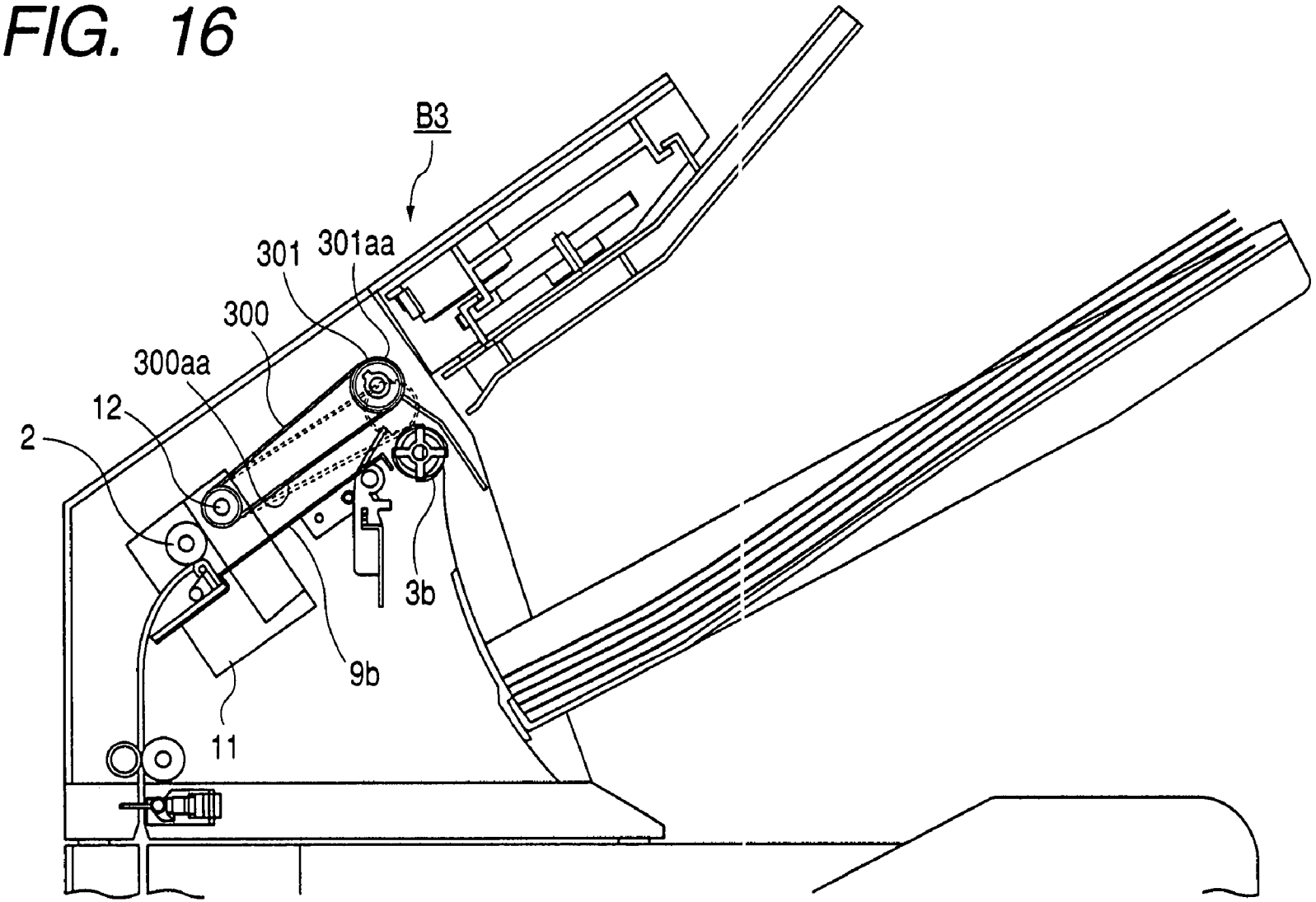
FIG. 16 shows the main part of the sheet post-processing apparatus of a third embodiment.

A sheet post-processing apparatus B3 of a third embodiment shown in FIG. 16 has the configuration in which the carrying upper guide, e.g. a belt 300, which turns according to the sheet discharging upper rotation, e.g. the rotation of a sheet discharging upper roller 301, is used instead of the conveying upper guide 9*a* shown in the sheet post-processing apparatuses B1 and B2 of the first and second embodiments. In this configuration, according to the upper movement of the sheet discharging upper roller 301 by the ascending means (not shown), the belt 300 is rotated upward around the fulcrum shaft 12. Consequently, there is no projection between the belt 300 and the sheet discharging upper roller 301, so that sheet can be smoothly conveyed.

Though the belt 300 turns according to the movement of the sheet discharging upper roller 301, the sheet discharging upper roller 301 may be only rotated and the belt 300 may be fixed without the rotation according to the movement of the sheet discharging upper roller 301. When the fixed belt is used, it is preferable to use the belt made of the material having low friction to the sheet and good sliding properties.

In FIGS. 14 and 15, a reference numeral 205 indicates a sheet detecting sensor lever for detecting the passage of the sheet which is being discharged. When the sheet is conveyed, the sheet detecting sensor lever 205 is pressed by the sheet and inclined downward to detect the sheet.

In the sheet post-processing apparatus B3 of the third embodiment, in addition to the achievement of the same effect as that of the sheet post-processing apparatus B1 of the first embodiment, the amount of separation and the amount of descend of the belt 300 to the conveying lower guide 9*b* can be set to a certain position in such a manner that the distance in the upward and downward directions of the arbitrary sheet path is selected by changing the ascending position of the sheet discharging upper roller 301 in each of the simply stacking mode and the sheet post-processing mode. Further, the distance of the sheet path can be controlled at the optimum position according to the number of bound sheets and the alignment of the sheet can be further improved.

OTHER EMBODIMENT

The arm 8, the conveying upper guide 9*a*, and the belt 300 are rotated upward and downward in the sheet post-processing apparatuses B1, B2, and B3 of the first to third embodiments. However, the arm 8, the conveying upper guide 9*a*, and the belt 300 may be moved in parallel upward and downward.

The sheet post-processing means is not limited to the stapler. The sheet post-processing means may be a perforating apparatus which makes a hole in the sheet, a gluing apparatus which glues the sheets together, thread binding means which binds the sheets with the thread, or the like.

The sheet discharging upper rotating body and the sheet discharging lower rotating body are not limited to the roller. The sheet discharging upper rotating body and the sheet discharging lower rotating body may be also the turning endless belt.

What is claimed is:

1. A sheet conveying apparatus comprising:

a sheet conveyor which conveys a sheet;

a conveying guide which guides the sheet conveyed by said sheet conveyor:

a sheet conveying rotating body which conveys the sheet guide by said conveying guide, and which is movable between a sheet conveying position and a retracting position; and a moving unit which moves said sheet conveying rotating body from the sheet conveying position to the retracting position, wherein a peripheral surface of said sheet conveying rotating body is projected from a sheet guiding surface of said conveying guide when said sheet conveying rotating body is in the sheet conveying position, and the peripheral surface of said sheet conveying rotating body is retracted from the sheet guiding surface of said conveying guide when said sheet conveying rotating body is in the retracting position.

2. A sheet conveying apparatus according to claim 1, further comprising an interlocking mechanism interlocking said conveying guide with said sheet conveying rotating body when said sheet conveying rotating body is moved from the sheet conveying position to the retracting position.

3. A sheet conveying apparatus according to claim 2, wherein when said sheet conveying rotating body is moved to the retracting position, said interlocking mechanism retracts said sheet conveying rotating body from the sheet guiding surface of said conveying guide and then moves said conveying guide.

4. A sheet conveying apparatus according to claim 2, wherein said interlocking mechanism comprises a pair of abutting portions which are provided in said conveying guide and an arm member for supporting said sheet conveying rotating body, and which are separable from each other, and the pair of abutting portions move said conveying guide in such a manner that the pair of abutting portions abut on each other.

5. A sheet conveying apparatus comprising:

a sheet conveyor which conveys a sheet;

a conveying guide which guides the sheet conveyed by said sheet conveyor, and which is movable between a sheet conveying position and a retracting position;

a sheet conveying rotating body which conveys the sheet guided by said conveying guide, and which is movable between a sheet conveying position and a retracting position, and a moving unit which moves said sheet conveying rotating body from the sheet conveying position to the retracting position, wherein a peripheral surface of said sheet conveying rotating body is projected from a sheet guiding surface of said conveying guide when said sheet conveying rotating body and said conveying guide are in the respective sheet conveying positions, and the peripheral surface of said sheet conveying rotating body is retracted from the sheet guiding surface of said conveying guide when said sheet conveying rotating body and said conveying guide are in the respective retracting positions.

6. A sheet conveying apparatus according to claim 5, further comprising an interlocking mechanism interlocking said conveying guide with said sheet conveying rotating body when said sheet conveying rotating body and said conveying guide are moved from the respective sheet conveying positions to the respective retracting positions.

7. A sheet conveying apparatus according to claim 6, wherein when said sheet conveying rotating body and said conveying guide are moved to the respective retracting positions, said interlocking mechanism retracts said sheet conveying rotating body from the sheet guiding surface of said conveying guide and then moves said conveying guide.

8. A sheet conveying apparatus according to claim 6, wherein said interlocking mechanism comprises a pair of abutting portions which are provided in said conveying guide and an arm member for supporting said sheet conveying rotating body, and which are separable from each other, and the pair of abutting portions move said conveying guide in such a manner that the pair of abutting portions abut on each other.

9. A sheet post-processing apparatus comprising:

a sheet post-processing unit which performs processing to a sheet; and a sheet conveying device, said sheet conveying device comprising:

a sheet conveyor which conveys a sheet;

a conveying guide which guides the sheet conveyed by said sheet conveyor:

a sheet conveying rotating body which conveys the sheet guided by said conveying guide, and which is movable between a sheet conveying position and a retracting position, a moving unit which moves said sheet conveying rotating body from the sheet conveying position to the retracting position, wherein a peripheral surface of said sheet conveying rotating body is projected from a sheet guiding surface of said conveying guide when said sheet conveying rotating body is in the sheet conveying position, and the peripheral surface of said sheet conveying rotating body is retracted from the sheet guiding surface of said conveying guide when said sheet conveying rotating body is in the retracting position.

10. A sheet post-processing apparatus according to claim 9, further comprising a pair of conveying guides oppositely provided in a vertical direction, wherein said conveying guide is an upper guide in said pair of conveying guides, and said sheet post-processing unit performs processing to a sheet stacked on a lower guide in said pair of conveying guides opposite to said conveying guide.

11. A sheet post-processing apparatus according to claim 10, comprising:

a first processing mode which positions said sheet conveying rotating body in the sheet conveying position, and conveys the sheet; and a second processing mode which moves said sheet conveying rotating body to the retracting position, in the second processing mode, the predetermined number of sheets are intermediately stored in said lower guide, performed post-processing by said sheet post-processing unit, and conveyed by said sheet conveying rotating body which moved to the sheet conveying position.

12. A sheet post-processing apparatus comprising:

a sheet post-processing unit which performs processing to a sheet; and a sheet conveying device, said sheet conveying device comprising:

a sheet conveyor which conveys a sheet;

a conveying guide which guides the sheet conveyed by said sheet conveyor:

a sheet conveying rotating body which conveys the sheet guided by said conveying guide, and which is movable between a sheet conveying position and a retracting position, and a moving unit which moves said sheet conveying rotating body from the sheet conveying position to the retracting position, wherein a peripheral surface of said sheet conveying rotating body is projected from a sheet guiding surface of said conveying guide when said sheet conveying rotating body and said conveying guide are in the respective sheet conveying positions, and the peripheral surface of said sheet conveying rotating body is retracted from the sheet guiding surface of said conveying guide when said sheet conveying rotating body and said conveying guide are in the respective retracting positions.

13. A sheet post-processing apparatus according to claim 12, further comprising a pair of conveying guides oppositely provided in a vertical direction, wherein said conveying guide is an upper guide in said pair of conveying guides, and said sheet post-processing unit performs processing to a sheet stacked on a lower guide in said pair of conveying guides opposite to said conveying guide.

14. A sheet post-processing apparatus according to claim 13, comprising:

a first processing mode which positions said sheet conveying rotating body and said conveying guide in the respective sheet conveying positions, and conveys the sheet; and a second processing mode which moves said sheet conveying rotating body and said conveying guide to the respective retracting positions, wherein in the second processing mode, the predetermined number of sheets are intermediately stored in said lower guide, post-processed by said sheet post-processing unit, and conveyed by said sheet conveying rotating body and said conveying guide which moved to the respective sheet conveying positions.

15. An image forming apparatus comprising:

an image forming portion which forms an image in a sheet; and a sheet conveying device which conveys the sheet, said sheet conveying device comprising:

a sheet conveyor which conveys a sheet;

a conveying guide which guides the sheet conveyed by said sheet conveyor: and a sheet conveying rotating body which conveys the sheet guided by said conveying guide, and which is movable between a sheet conveying position and a retracting position, and a moving unit which moves said sheet conveying rotating body from the sheet conveying position to the retracting position, wherein a peripheral surface of said sheet conveying rotating body is projected from a sheet guiding surface of said conveying guide when said sheet conveying rotating body is in the sheet conveying position, and the peripheral surface of said sheet conveying rotating body is retracted from the sheet guiding surface of said conveying guide when said sheet conveying rotating body is in the retracting position.

16. An image forming apparatus according to claim 15, further comprising an interlocking mechanism interlocking said conveying guide with said sheet conveying rotating body when said sheet conveying rotating body is moved from the sheet conveying position to the retracting position.

17. An image forming apparatus comprising:

an image forming portion which forms an image in a sheet; and a sheet conveying device which conveys the sheet, said sheet conveying device comprising:

a sheet conveyor which conveys a sheet;

a conveying guide which guides the sheet conveyed by said sheet conveyor, and which is movable between a sheet conveying position and a retracting position;

a sheet conveying rotating body which conveys the sheet guided by said conveying guide, and which is movable between a sheet conveying position and a retracting position, a moving unit which moves said sheet conveying rotating body from the sheet conveying position to the retracting position, wherein a peripheral surface of said sheet conveying rotating body is projected from a sheet guiding surface of said conveying guide when said sheet conveying rotating body and said conveying guide are in the respective sheet conveying positions, and the peripheral surface of said sheet conveying rotating body is retracted from the sheet guiding surface of said conveying guide when said sheet conveying rotating body and said conveying guide are in the respective retracting positions.

18. An image forming apparatus according to claim 17, further comprising an interlocking mechanism interlocking said conveying guide with said sheet conveying rotating body when said sheet conveying rotating body and said conveying guide are moved from the respective sheet conveying positions to the respective retracting positions.

19. An image forming apparatus comprising:

image forming portion which forms an image in a sheet; and a sheet post-processing device which performs post-processing in which an image is formed by said image forming means to the sheet, said sheet post-processing device comprising:

a sheet conveyor which conveys a sheet;

a conveying guide which guides the sheet conveyed by said sheet conveyor:

a sheet conveying rotating body which conveys the sheet guided by said conveying guide, and which is movable between a conveying position and a retracting position, and a moving unit which moves said sheet conveying rotating body from the sheet conveying position to the retracting position, wherein a peripheral surface of said sheet conveying rotating body is projected from a sheet guiding surface of said conveying guide when said sheet conveying rotating body is in the sheet conveying position, and the peripheral surface of said sheet conveying rotating body is retracted from the sheet guiding surface of said conveying guide when said sheet conveying rotating body is in the retracting position.

20. An image forming apparatus according to claim 19, further comprising an interlocking mechanism interlocking said conveying guide with said sheet conveying rotating body when said sheet conveying rotating body is moved from the sheet conveying position to the retracting position.

21. An image forming apparatus comprising:

image forming portion which forms an image in a sheet; and a sheet post-processing device which performs post-processing in which an image is formed by said image forming means to the sheet, said sheet post-processing device comprising:

a sheet conveyor which conveys a sheet;

a conveying guide which guides the sheet conveyed by said sheet conveyor:

a sheet conveying rotating body which conveys the sheet guided by said conveying guide, and which is movable between a conveying position and a retracting position, and a moving unit which moves said sheet conveying rotating body from the sheet conveying position to the retracting position, wherein a peripheral surface of said sheet conveying rotating body is projected from a sheet guiding surface of said conveying guide when said sheet conveying rotating body and said conveying guide are in the respective sheet conveying positions, and the peripheral surface of said sheet conveying rotating body is retracted from the sheet guiding surface of said conveying guide when said sheet conveying rotating body and said conveying guide are in the respective retracting positions.

22. An image forming apparatus according to claim 21, further comprising an interlocking mechanism interlocking said conveying guide with said sheet conveying rotating body when said sheet conveying rotating body and said conveying guide are moved from the respective sheet conveying positions to the respective retracting positions.

* * * * *

UNITED STATES PATENT AND TRADEMARK OFFICE

CERTIFICATE OF CORRECTION

PATENT NO. : 7,192,029 B2
APPLICATION NO. : 11/262914
DATED : March 20, 2007
INVENTOR(S) : Masayoshi Fukatsu et al.

It is certified that error appears in the above-identified patent and that said Letters Patent is hereby corrected as shown below:

ON THE TITLE PAGE:
At Item (*), Notice, insert --This patent is subject to a Terminal Disclaimer.--.

Signed and Sealed this

Eleventh Day of December, 2007

JON W. DUDAS
*Director of the United States Patent and Trademark Office*